US010479468B2

(12) United States Patent
Kumita

(10) Patent No.: US 10,479,468 B2
(45) Date of Patent: Nov. 19, 2019

(54) OUTBOARD MOTOR

(71) Applicant: YAMAHA HATSUDOKI KABUSHIKI KAISHA, Iwata-shi, Shizuoka (JP)

(72) Inventor: Atsushi Kumita, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 0 days.

(21) Appl. No.: 16/137,576

(22) Filed: Sep. 21, 2018

(65) Prior Publication Data

US 2019/0144093 A1 May 16, 2019

(30) Foreign Application Priority Data

Nov. 13, 2017 (JP) ..... 2017-218540

(51) Int. Cl.

| | |
|---|---|
| ***B63H 20/00*** | (2006.01) |
| ***F02B 61/04*** | (2006.01) |
| ***F02B 75/20*** | (2006.01) |
| ***B63H 20/32*** | (2006.01) |

(52) U.S. Cl.

CPC ..... *B63H 20/002* (2013.01); *B63H 20/32* (2013.01)

(58) Field of Classification Search

CPC .... B63H 20/001; B63H 20/002; B63H 20/32; B63H 2020/32; B63H 2020/323

USPC ..... 440/76, 77, 78, 88 R, 88 L

See application file for complete search history.

(56) References Cited

U.S. PATENT DOCUMENTS

| | | | | |
|---|---|---|---|---|
| 4,371,348 | A * | 2/1983 | Blanchard | B63H 5/1252 440/52 |
| 4,572,120 | A * | 2/1986 | Matsumoto | F01M 11/00 123/196 S |
| 4,735,590 | A * | 4/1988 | Mondek | F01M 5/002 165/42 |
| 4,872,531 | A * | 10/1989 | Meisenburg | B63H 20/002 184/6.4 |
| 5,820,425 | A * | 10/1998 | Ogino | B63H 5/10 440/78 |
| 6,234,855 | B1 * | 5/2001 | Watanabe | F02B 61/045 440/76 |
| 8,435,090 | B1 * | 5/2013 | Lonnborg | B63H 20/002 440/78 |
| 2008/0017451 | A1 | 1/2008 | Fukuoka et al. | |
| 2017/0113772 | A1 | 4/2017 | Kumita | |

FOREIGN PATENT DOCUMENTS

| | | | |
|---|---|---|---|
| JP | 2017-81372 | A | 5/2017 |
| WO | 2005/040662 | A1 | 5/2005 |

* cited by examiner

*Primary Examiner* — Daniel V Venne

(74) *Attorney, Agent, or Firm* — Keating and Bennett, LLP

(57) ABSTRACT

An outboard motor includes an upper case, a lower case including an oil reservoir chamber, an oil flow passage, and an oil flow passage shutoff valve. When the lower case is detached from the upper case, the oil flow passage is separated into an upper oil flow passage in the upper case and a lower oil flow passage in the lower case and connected to the oil reservoir chamber. The oil flow passage shutoff valve opens the lower oil flow passage in a state in which the lower case has been attached to the upper case. The oil flow passage shutoff valve closes the lower oil flow passage in a state in which the lower case has been detached from the upper case.

14 Claims, 9 Drawing Sheets

OUTBOARD MOTOR

CROSS REFERENCE TO RELATED APPLICATIONS

This application claims the benefit of priority to Japanese Patent Application No. 2017-218540 filed on Nov. 13, 2017. The entire contents of this application are hereby incorporated herein by reference.

BACKGROUND OF THE INVENTION

1. Field of the Invention

The present invention relates to an outboard motor that includes a lower case that is detachable from the outboard motor while containing lubrication oil.

2. Description of the Related Art

An outboard motor disclosed by Japanese Patent Application Publication No. 2017-81372 includes an engine, a power transmitting device that transmits the power of the engine to a propeller, and a casing that contains the power transmitting device. The rotation of a crankshaft included in the engine is transmitted to the propeller via a drive shaft, a gear mechanism and a propeller shaft of the power transmitting device. The casing includes an upper case located below the engine and a lower case located below the upper case. The gear mechanism is located in a gear chamber provided in the lower case. The gear chamber is filled with lubrication oil with which the gear mechanism is lubricated. The outboard motor further includes an oil passage that guides lubrication oil when the lubrication oil in the gear chamber is replaced. The oil passage includes an oil hose provided in the upper case, and a lower oil-passage that is formed in the lower case and that is connected to the gear chamber. The oil hose is connected to the lower case via an oil joint inserted in the lower oil passage.

The present inventor has analyzed an arrangement in which a lower case is attachable to and detachable from an upper case in an outboard motor arranged as in Japanese Patent Application Publication No. 2017-81372. In this examination, when an operator detaches the lower case from the upper case for maintenance or the like, an oil hose comes off from an oil joint, and, as a result, an oil passage is separated into the oil hose and a lower oil-passage. If the operator tilts the lower case in order to, for example, attach or detach the lower case in this state, there is a concern that lubrication oil in a gear chamber will leak out from the oil joint through the lower oil passage. Additionally, there is a possible situation in which the outboard motor is transported in a state in which the lower case has been detached from the upper case. The inside of the gear chamber is required to be filled with lubrication oil during transportation in order to prevent a gear mechanism and the like from being corroded. Likewise, in this situation, there is a concern that lubrication oil in the gear chamber will leak out from the oil joint if the lower case is tilted.

SUMMARY OF THE INVENTION

In order to overcome the previously unrecognized and unsolved challenges described above, preferred embodiments of the present invention provide outboard motors that each include an engine, a drive shaft, a gearing, a propeller shaft, an upper case, a lower case, an oil flow passage, and an oil flow passage shutoff valve. The drive shaft extends downwardly from the engine and is rotated by the engine. The gearing is connected to a lower end of the drive shaft. A propeller is attached to the propeller shaft, and rotation of the drive shaft is transmitted to the propeller shaft via the gearing. The upper case is located below the engine and houses the drive shaft. An oil reservoir chamber containing the gearing and lubrication oil is provided in the lower case. The lower case is located below the upper case, and is attachable to and detachable from the upper case. The oil flow passage includes an upper oil flow passage provided in the upper case and a lower oil flow passage provided in the lower case and that is connected to the oil reservoir chamber, and the oil flow passage guides lubrication oil when lubrication oil in the oil reservoir chamber is replaced. The oil flow passage is separated into the upper oil flow passage and the lower oil flow passage when the lower case is detached from the upper case. The oil flow passage shutoff valve opens the lower oil flow passage in a state in which the lower case has been attached to the upper case. The oil flow passage shutoff valve closes the lower oil flow passage in a state in which the lower case has been detached from the upper case.

In accordance with the preferred embodiment described above, the oil flow passage shutoff valve opens the lower oil flow passage in a state in which the lower case has been attached to the upper case, and therefore the upper oil flow passage and the lower oil flow passage are connected to each other, and the oil flow passage changes to an open state. This enables the oil flow passage to replace lubrication oil in the oil reservoir chamber. On the other hand, in a state in which the lower case has been detached from the upper case, the oil flow passage is separated into the upper oil flow passage and the lower oil flow passage, and the oil flow passage shutoff valve closes the lower oil flow passage. This makes it possible to prevent lubrication oil in the oil reservoir chamber from flowing out from the lower case through the lower oil flow passage. Therefore, it is possible to prevent lubrication oil from leaking out from the detachable lower case.

In a preferred embodiment of the present invention, an outboard motor further includes a lower oil joint and an upper oil joint. The lower oil joint is provided at the lower oil flow passage, and the oil flow passage shutoff valve is located in the lower oil joint. The upper oil joint is provided at the upper oil flow passage, and is connectable to the lower oil joint. The upper oil joint includes an actuator that applies an opening operation to the oil flow passage shutoff valve.

In accordance with the preferred embodiment described above, the lower oil joint of the lower oil flow passage and the upper oil joint of the upper oil flow passage are joined together when the lower case is attached to the upper case. Consequently, the actuator of the upper oil joint allows the oil flow passage shutoff valve located in the lower oil joint to undergo an opening operation, and the oil flow passage shutoff valve opens the lower oil flow passage. On the other hand, when the lower case is detached from the upper case, the connection between the lower oil joint and the upper oil joint is released. Consequently, the actuator does not apply an opening operation to the oil flow passage shutoff valve, and therefore the oil flow passage shutoff valve closes the lower oil flow passage. As thus described, it is possible to achieve the opening and closing of the lower oil flow passage by the oil flow passage shutoff valve in conjunction with the connection or disconnection between the lower oil joint and the upper oil joint in response to the attaching or detaching of the lower case to or from the upper case.

In a preferred embodiment of the present invention, an upper oil connection port that is opened so as to face downwardly is provided in the upper oil joint. The actuator is provided in the upper oil connection port. A lower oil connection port that is opened so as to face upwardly and that is connected to the upper oil connection port is provided in the lower oil joint. The oil flow passage shutoff valve includes a valve body that is slidable upwardly and downwardly in the lower oil flow passage, a valve seat that receives the valve body, and an urging member that upwardly urges the valve body toward the valve seat. A gap that allows the upper oil flow passage and the lower oil flow passage to communicate with each other is located between the valve body and the valve seat by allowing the valve body to be downwardly pushed by the actuator in a state in which the oil flow passage shutoff valve has opened the lower oil flow passage. When the lower case is detached from the upper case, the valve body approaches the valve seat by urging of the urging member, and the gap closes, and, as a result, the oil flow passage shutoff valve closes the lower oil flow passage.

In accordance with the preferred embodiment described above, the valve body of the oil flow passage shutoff valve is downwardly pushed by the actuator in the upper oil connection port of the upper oil joint when the lower case is attached to the upper case. Consequently, the gap that allows the upper oil flow passage and the lower oil flow passage to communicate with each other is created between the valve body and the valve seat in the oil flow passage shutoff valve. Therefore, it is possible to achieve the opening action of the lower oil flow passage with the oil flow passage shutoff valve. On the other hand, when the lower case is detached from the upper case, the valve body is not pushed by the actuator, and the valve body that is raised by the urging of the urging member approaches the valve seat in the oil flow passage shutoff valve. Consequently, the gap that allows the upper oil flow passage and the lower oil flow passage to communicate with each other closes, and therefore it is possible to achieve the closing action of the lower oil flow passage with the oil flow passage shutoff valve.

In a preferred embodiment of the present invention, the lower oil joint is inserted into the upper oil connection port in a state in which the oil flow passage shutoff valve has opened the lower oil flow passage. In accordance with this preferred embodiment, the lower oil connection port of the lower oil joint is connected to the upper oil connection port in the upper oil flow passage. This makes it possible to prevent lubrication oil in the oil flow passage from leaking out from a joint between the lower oil connection port and the upper oil connection port because the joint reaches an unexposed state to the outside of the oil flow passage that has been opened.

In a preferred embodiment of the present invention, an outboard motor further includes a first seal that closes a gap between the lower oil joint inserted into the upper oil connection port and an inner surface of the upper oil flow passage. In accordance with this preferred embodiment, the first seal is able to prevent lubrication oil in the oil flow passage from leaking out from the gap between the lower oil joint and the inner surface of the upper oil flow passage.

In a preferred embodiment of the present invention, the outboard motor further includes an extension member, a lower oil joint, a relay oil flow passage, and a relay oil joint. The extension member is located between the upper case and the lower case, and is fixed to the upper case. The lower oil joint is provided at the lower oil flow passage, and the oil flow passage shutoff valve is built into the lower oil joint. The relay oil flow passage is provided at the extension member, and extends downwardly from the upper oil flow passage. The relay oil joint is provided at the relay oil flow passage, and is connectable to the lower oil joint. The relay oil joint includes an actuator that opens the oil flow passage shutoff valve.

In accordance with the preferred embodiment described above, the lower oil joint of the lower oil flow passage and the relay oil joint of the relay oil flow passage in the extension member are joined together when the lower case is attached to the extension member. Consequently, the actuator of the relay oil joint opens the oil flow passage shutoff valve built into the lower oil joint, and the oil flow passage shutoff valve opens the lower oil flow passage. Thereupon, the upper oil flow passage, the relay oil flow passage, and the lower oil flow passage are connected together, and the oil flow passage reaches an open state. On the other hand, when the lower case is detached from the extension member, the connection between the lower oil joint and the relay oil joint is released. Consequently, the actuator does not open the oil flow passage shutoff valve, and therefore the oil flow passage shutoff valve closes the lower oil flow passage. As thus described, it is possible to realize the opening and closing of the lower oil flow passage by the oil flow passage shutoff valve in conjunction with the connection or disconnection between the lower oil joint and the relay oil joint in response to the attaching or detaching of the lower case to or from the extension member.

In a preferred embodiment of the present invention, a relay oil port that opens downwardly is provided in the relay oil flow passage. The actuator is provided in the relay oil port. A lower oil connection port that opens upwardly and that is connected to the relay oil port is provided in the lower oil joint. The oil flow passage shutoff valve includes a valve body that is slidable upwardly and downwardly in the lower oil flow passage, a valve seat that receives the valve body, and an urging member that upwardly urges the valve body toward the valve seat. A gap that allows the relay oil flow passage and the lower oil flow passage to communicate with each other is created between the valve body and the valve seat by allowing the valve body to be downwardly pushed by the actuator in a state in which the oil flow passage shutoff valve has opened the lower oil flow passage. When the lower case is detached from the extension member, the valve body approaches the valve seat by urging of the urging member, and the gap closes, and, as a result, the oil flow passage shutoff valve closes the lower oil flow passage.

In accordance with the preferred embodiment described above, the valve body of the oil flow passage shutoff valve is downwardly pushed by the actuator in the relay oil port of the relay oil flow passage when the lower case is attached to the extension member. Consequently, the gap that allows the relay oil flow passage and the lower oil flow passage to communicate with each other is created between the valve body and the valve seat in the oil flow passage shutoff valve. Therefore, it is possible to realize the opening action of the lower oil flow passage by the oil flow passage shutoff valve. On the other hand, when the lower case is detached from the extension member, the valve body is not pushed by the actuator, and the valve body that is raised by the urging of the urging member approaches the valve seat in the oil flow passage shutoff valve. Consequently, the gap that allows the relay oil flow passage and the lower oil flow passage to communicate with each other closes, and therefore it is possible to realize the closing action of the lower oil flow passage by the oil flow passage shutoff valve.

In a preferred embodiment of the present invention, the lower oil joint is inserted into the relay oil port in a state in which the oil flow passage shutoff valve has opened the lower oil flow passage. In accordance with the preferred embodiment described above, the lower oil connection port of the lower oil joint is connected to the relay oil port in the relay oil flow passage. This makes it possible to prevent lubrication oil in the oil flow passage from leaking out from a joint between the lower oil connection port and the relay oil port because the joint reaches an unexposed state to the outside of the oil flow passage that has been opened.

In a preferred embodiment of the present invention, the outboard motor further includes a second seal that closes a gap between the lower oil joint inserted into the relay oil port and an inner surface of the relay oil flow passage. In accordance with the preferred embodiment described above, the second seal prevents lubrication oil in the oil flow passage from leaking out from the gap between the lower oil joint and the inner surface of the relay oil flow passage.

In a preferred embodiment of the present invention, the oil flow passage shutoff valve further includes a third seal. The third seal is attached to the valve body, and closes a gap between the valve body and the valve seat by being compressed between the valve body and the valve seat in a state in which the lower case has been detached from the upper case. In accordance with the preferred embodiment described above, the oil flow passage shutoff valve closes the lower oil flow passage by allowing the third seal to be compressed between the valve body and the valve seat and to close the gap between the valve body and the valve seat in a state in which the lower case has been detached from the upper case.

In a preferred embodiment of the present invention, an outboard motor further includes an air flow passage. The air flow passage is provided in the upper case, and includes an upper air flow passage that opens to atmosphere when lubrication oil in the oil reservoir chamber is replaced, and a lower air flow passage that is provided in the lower case and that is connected to the oil reservoir chamber. The air flow passage is separated into the upper air flow passage and the lower air flow passage when the lower case is detached from the upper case.

In accordance with the preferred embodiment described above, air from the atmosphere flows into the oil reservoir chamber through the upper air flow passage and the lower air flow passage when used lubrication oil in the oil reservoir chamber is discharged outwardly from the outboard motor through the oil flow passage during lubrication oil replacement in the oil reservoir chamber. Lubrication oil and air change places with each other in the oil reservoir chamber, and, as a result, it is possible to smoothly discharge used lubrication oil in the oil reservoir chamber. On the other hand, when new lubrication oil flows into the oil reservoir chamber through the oil flow passage, air in the oil reservoir chamber is discharged outwardly from the outboard motor through the lower air flow passage and through the upper air flow passage. Lubrication oil and air change places with each other in the oil reservoir chamber, and, as a result, it is possible to smoothly add new lubrication oil to the oil reservoir chamber.

In a preferred embodiment of the present invention, the outboard motor further includes an air flow passage shutoff valve. The air flow passage shutoff valve opens the lower air flow passage in a state in which the lower case has been attached to the upper case. The air flow passage shutoff valve closes the lower air flow passage in a state in which the lower case has been detached from the upper case.

In accordance with the preferred embodiment described above, the air flow passage shutoff valve opens the lower air flow passage in a state in which the lower case has been attached to the upper case, and therefore the upper air flow passage and the lower air flow passage are connected to each other, and the air flow passage reaches an open state, and is opened to the atmosphere. Therefore, lubrication oil and air change places with each other in the oil reservoir chamber during lubrication oil replacement, and therefore it is possible to smoothly discharge used lubrication oil in the oil reservoir chamber and is possible to smoothly add new lubrication oil to the oil reservoir chamber. On the other hand, the air flow passage shutoff valve closes the lower air flow passage in a state in which the lower case has been detached from the upper case. This makes it possible to prevent lubrication oil in the oil reservoir chamber from flowing out from the lower case through the lower air flow passage. Therefore, it is possible to prevent lubrication oil from leaking out from the detachable lower case.

In a preferred embodiment of the present invention, the lower case is attachable to and detachable from the upper case together with the drive shaft. In accordance with the preferred embodiment described above, it is supposed that the lower case that has been detached from the upper case will be tilted so that the drive shaft lies down, and yet, in this situation, it is possible to prevent lubrication oil from leaking out from the lower case.

In a preferred embodiment of the present invention, the outboard motor is turnable around a tilting shaft extending in a horizontal direction between a tilt-down position in which the lower case is positioned in water and a tilt-up position in which the lower case is positioned above a water surface. A forward end farthest from the oil reservoir chamber in the upper oil flow passage is located at a higher position than the tilting shaft. The outboard motor further includes a coupler that is provided at the forward end and that makes a one-touch connection with external equipment for lubrication oil replacement.

In accordance with the preferred embodiment described above, the forward end of the upper oil flow passage is located at a position that is easily accessed by the operator when the outboard motor is turned to the tilt-up position. The coupler provided at the forward end makes a one-touch connection with external equipment for lubrication oil replacement. This enables the operator to easily perform a lubrication oil replacement operation by turning the outboard motor to the tilt-up position and by connecting the coupler to the external equipment in a one-touch connection manner.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

First Preferred Embodiment

Figure 1:
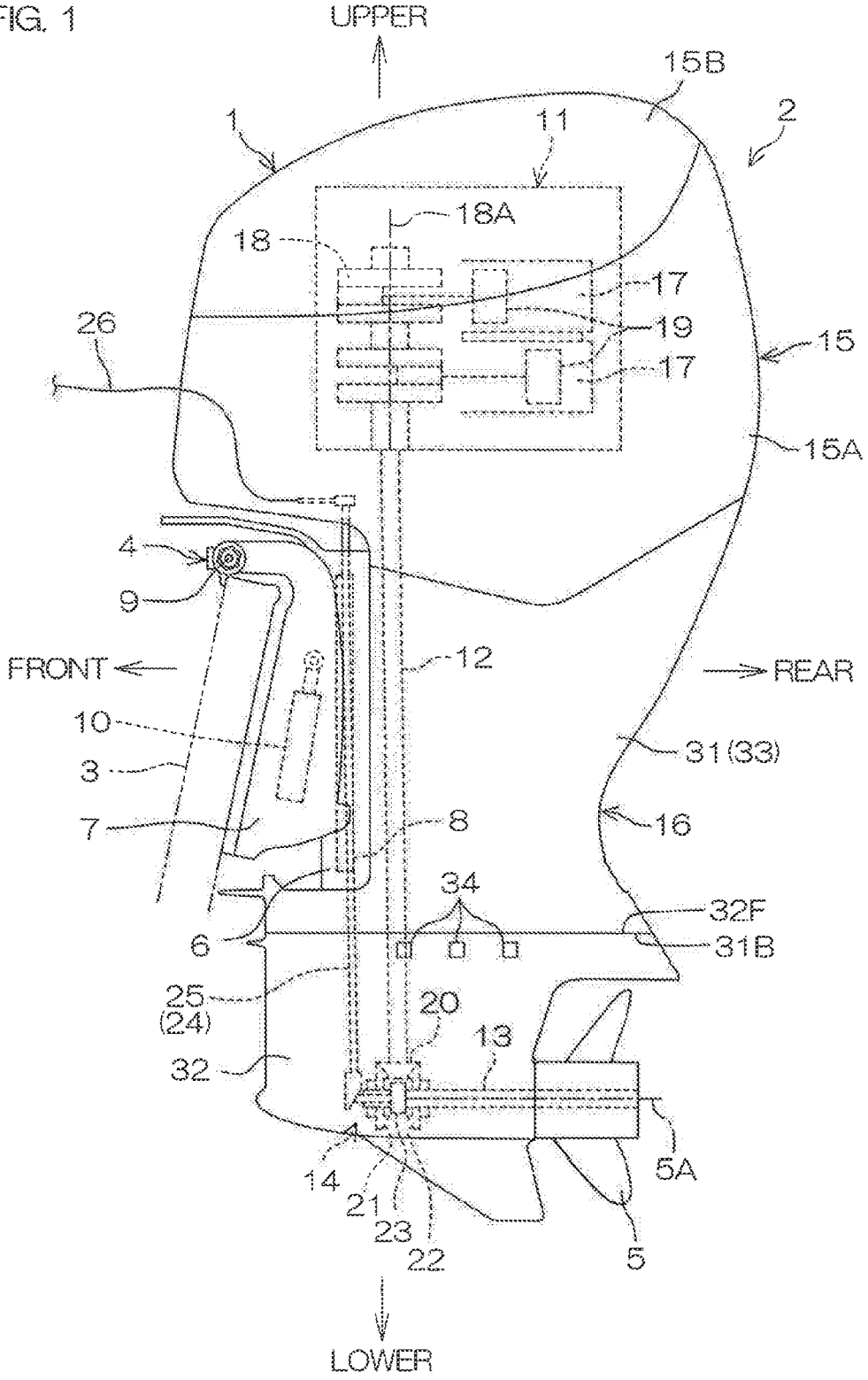
FIG. 1 is a schematic left side view of a vessel propulsion device including an outboard motor according to a preferred embodiment of the present invention.

Preferred embodiments of the present invention will be hereinafter described in detail with reference to the accompanying drawings. FIG. 1 is a schematic left side view of a vessel propulsion device 2 including an outboard motor 1 according to a preferred embodiment of the present invention. The vessel propulsion device 2 includes the outboard motor 1 that generates thrust by which a vessel is propelled, and a mounting mechanism 4 to mount the outboard motor 1 on a hull 3. The left side in FIG. 1 is the front side of the outboard motor 1, and the right side in FIG. 1 is the rear side of the outboard motor 1. The near side in a direction perpendicular to the plane of paper of FIG. 1 is the left side of the outboard motor 1, and the far side in the direction perpendicular to the plane of paper of FIG. 1 is the right side of the outboard motor 1. FIG. 1 shows the outboard motor 1 in a tilt-down position. The "tilt-down position" is a position of the outboard motor 1 in a perpendicular or substantially perpendicular attitude when a rotation axis 5A of a propeller 5 extends in both a horizontal direction and a front-rear direction of the outboard motor 1. The outboard motor 1 in the tilt-down position will be hereinafter described unless otherwise noted.

The mounting mechanism 4 includes a swivel bracket 6, a clamp bracket 7, a steering shaft 8, and a tilting shaft 9. The steering shaft 8 is located so as to extend in an up-down direction. The tilting shaft 9 extends in a left-right direction along the horizontal direction. The swivel bracket 6 is connected to the outboard motor 1 via the steering shaft 8. The clamp bracket 7 is connected to the swivel bracket 6 via the tilting shaft 9. The clamp bracket 7 is fixed to a rear portion of the hull 3. Consequently, the outboard motor 1 is mounted on the rear portion of the hull 3 by the mounting mechanism 4.

The outboard motor 1 and the swivel bracket 6 are turnable upwardly and downwardly around the tilting shaft 9 with respect to the clamp bracket 7. The outboard motor 1 is turned around the tilting shaft 9, and, as a result, the outboard motor 1 is tilted with respect to the hull 3 and the clamp bracket 7. The outboard motor 1 is turnable between the tilt-down position and a tilt-up position (see FIG. 8 that is described below). When the outboard motor 1 is in the tilt-down position, the propeller 5 is positioned in the water. When the outboard motor 1 is in the tilt-up position, the propeller 5 is positioned above a water surface. The outboard motor 1 is turnable together with the steering shaft 8 rightwardly and leftwardly with respect to the swivel bracket 6 and the clamp bracket 7.

The vessel propulsion device 2 includes a steering mechanism (not shown) that turns the outboard motor 1 rightwardly and leftwardly, and a power tilt & trim mechanism (hereinafter, referred to as a "PTT") 10 that turns the outboard motor 1 upwardly and downwardly. The PTT 10 includes an oil hydraulic cylinder and the like, and is connected to the swivel bracket 6 and to the clamp bracket 7. An operator operates an up/down switch (not shown) provided at a driving seat (not shown) of the hull 3 or at the outboard motor 1, and actuates the PTT 10. Thereupon, the PTT 10 turns the outboard motor 1 toward an arbitrary position from the tilt-down position to the tilt-up position.

The outboard motor 1 includes an engine 11, a drive shaft 12, a propeller shaft 13, a gearing 14, an engine cover 15, and a casing 16.

The engine 11 is an internal combustion engine that generates power by burning fuel, such as gasoline, and includes a combustion chamber 17, a crankshaft 18, and a piston 19 each of which is a built-in component. The crankshaft 18 has a crankshaft axis 18A that extends in the up-down direction. The piston 19 reciprocates rectilinearly in the front-rear direction perpendicular to the crankshaft axis 18A by burning an air fuel mixture in the combustion chamber 17. Consequently, the crankshaft 18 is rotated around the crankshaft axis 18A.

The drive shaft 12 extends downwardly from the engine 11. The drive shaft 12 is rotatable together with the crankshaft 18, and is rotated by the engine 11. The drive shaft 12 is connected to a lower end of the crankshaft 18 by, for example, a spline connection. Therefore, the operator is able to release the connection between the drive shaft 12 and the crankshaft 18 by downwardly displacing the drive shaft 12 during maintenance.

The propeller shaft 13 extends in the front-rear direction below a lower end of the drive shaft 12. The propeller 5 is attached to a rear end of the propeller shaft 13. The gearing 14 is connected to the lower end of the drive shaft 12 and to a front end of the propeller shaft 13. The rotation of the drive shaft 12 is transmitted to the propeller shaft 13 via the gearing 14. The gearing 14 includes a driving gear 20, a first transmission gear 21, a second transmission gear 22, and a clutch body 23. The outboard motor 1 further includes a shift mechanism 24 that moves the clutch body 23.

The driving gear 20, the first transmission gear 21, and the second transmission gear 22 are, for example, cylindrical bevel gears, respectively. The driving gear 20 is attached to the lower end of the drive shaft 12. The first transmission gear 21 surrounds a portion at a more forward position than the driving gear 20 at the front end of the propeller shaft 13. The second transmission gear 22 surrounds a portion at a more rearward position than the driving gear 20 at the front end of the propeller shaft 13. The first transmission gear 21 and the second transmission gear 22 are located so as to face each other with an interval therebetween in the front-rear direction, and are engaged with the driving gear 20. When the driving gear 20 rotates together with the drive shaft 12 in response to the driving of the engine 11, the rotation of the driving gear 20 is transmitted to the first transmission gear 21 and to the second transmission gear 22. Consequently, the first transmission gear 21 and the second transmission gear 22 rotate around the propeller shaft 13 in mutually opposite directions.

The clutch body 23 is located between the first transmission gear 21 and the second transmission gear 22. The clutch body 23 is, for example, a cylindrical dog clutch, and surrounds the front end of the propeller shaft 13. The clutch body 23 is connected to the front end of the propeller shaft 13 by, for example, a spline. Therefore, the clutch body 23 rotates together with the front end of the propeller shaft 13. Additionally, the clutch body 23 is movable in the front-rear direction with respect to the front end of the propeller shaft 13.

The shift mechanism 24 includes a shift rod 25 that extends in the up-down direction. The shift rod 25 is joined to an operation cable 26 connected to an operation lever (not shown) that is operated by a vessel operator. The shift rod 25 turns around an axis of the shift rod 25 by an operating force that is input from the operation cable 26. The clutch body 23 is moved in the front-rear direction by turning the shift rod 25, and is placed at any one of a neutral position, a forward position, and a backward position.

The neutral position is a position at which the clutch body 23 is engaged neither with the first transmission gear 21 nor with the second transmission gear 22, and is a position between the forward position and the backward position. In a state in which the clutch body 23 is placed at the neutral position, the rotation of the drive shaft 12 is not transmitted to the propeller shaft 13, and therefore the shift position of the outboard motor 1 is "neutral."

The forward position is a position at which the clutch body 23 is engaged with an inner peripheral portion of the first transmission gear 21, and the backward position is a position at which the clutch body 23 is engaged with an inner peripheral portion of the second transmission gear 22. In a state in which the clutch body 23 is placed at the forward position and is connected to the first transmission gear 21, the rotation of the first transmission gear 21 is transmitted to the propeller shaft 13, and therefore the shift position of the outboard motor 1 is "forward." When the rotation of the first transmission gear 21 is transmitted to the propeller shaft 13, the propeller 5 rotates in a forward rotational direction. Consequently, a forward thrust is generated. In a state in which the clutch body 23 is placed at the backward position and is connected to the second transmission gear 22, the rotation of the second transmission gear 22 is transmitted to the propeller shaft 13, and therefore the shift position of the outboard motor 1 is "backward." When the rotation of the second transmission gear 22 is transmitted to the propeller shaft 13, the propeller 5 rotates in a backward rotational direction opposite to the forward rotational direction. Consequently, a backward thrust is generated. The relationship between the forward position and the backward position may be reversed.

The engine cover 15 is preferably box-shaped, and contains the engine 11 and at least an upper end of the drive shaft 12. The engine cover 15 includes a cylindrical bottom cover 15A located around a lower portion of the engine 11 and a cup-shaped top cover 15B detachably attached to the bottom cover 15A.

The casing 16 is a hollow body that extends downwardly from the engine cover 15, and is preferably made of metal, such as aluminum. The casing 16 includes an exhaust guide (not shown) located below the engine 11, an upper case 31 located below the exhaust guide, and a lower case 32 located below the upper case 31.

The drive shaft 12 passes through the exhaust guide. The outer coat portion of the upper case 31 includes an apron 33. The apron 33 may be detachable from the upper case 31. The upper case 31 contains a middle portion of the drive shaft 12.

The lower case 32 contains at least the lower end of the drive shaft 12, the propeller shaft 13, the gearing 14, and at least a lower end of the shift rod 25. The propeller 5 attached to the rear end of the propeller shaft 13 protrudes rearwardly from the lower case 32. When the outboard motor 1 is in the tilt-down position, at least a portion of the lower case 32 is positioned in the water together with the propeller 5. When the outboard motor 1 is in the tilt-up position, the lower case 32 is positioned above a water surface together with the propeller 5 (see FIG. 8). The lower case 32 is fixed to the upper case 31 by a fastener 34, such as a bolt or the like. The operator is able to detach the lower case 32 from the upper case 31 by detaching the fastener 34. In other words, the lower case 32 is attachable to and detachable from the upper case 31. The drive shaft 12 is able to be detached from the crankshaft 18 as described above, and therefore the lower case 32 is attachable to and detachable from the upper case 31 together with the drive shaft 12.

Figure 2:
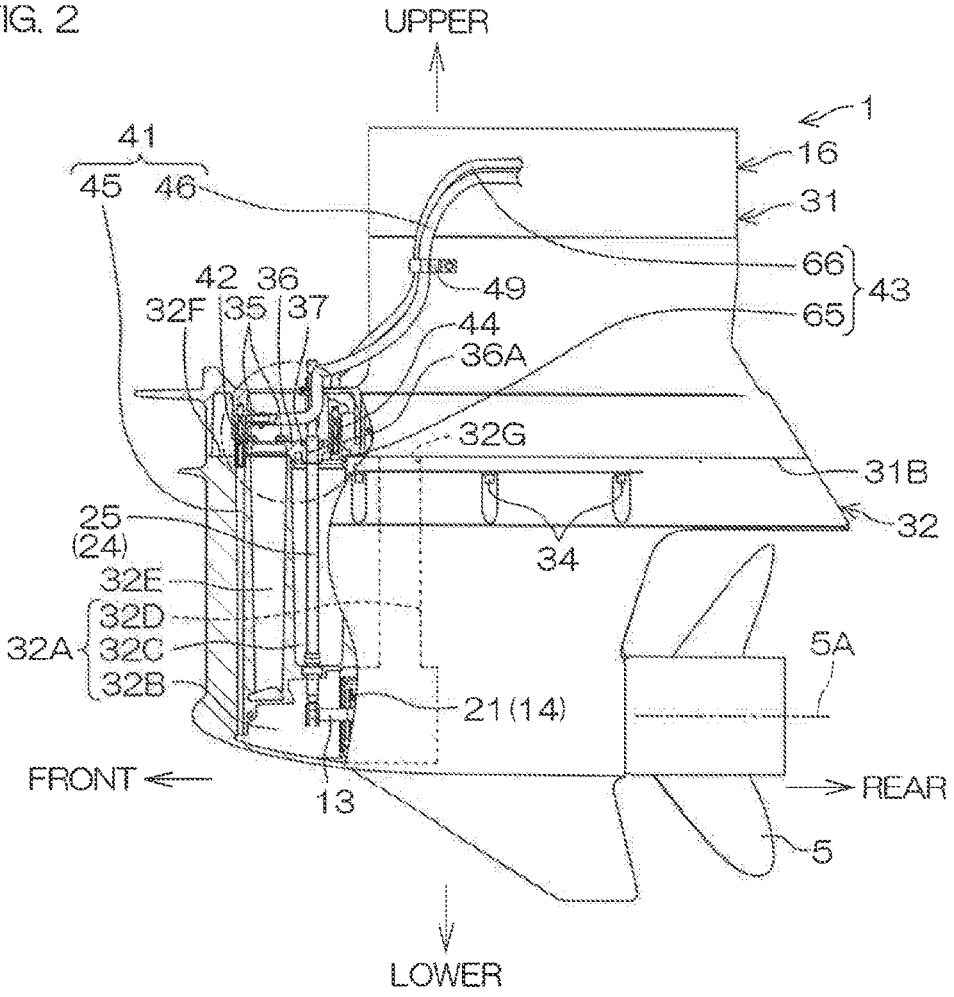
FIG. 2 is a partial cross-sectional view showing a left side of an upper case and of a lower case of the outboard motor.

FIG. 2 is a partial cross-sectional view showing a left side of the upper case 31 and of the lower case 32. An oil reservoir chamber 32A is provided in the lower case 32. The oil reservoir chamber 32A includes a lateral area 32B that extends in the front-rear direction, a first longitudinal area 32C that extends in the up-down direction, and a second longitudinal area 32D that extends in the up-down direction.

The lateral area 32B contains the front end of the propeller shaft 13, the gearing 14, and the lower end of the shift rod 25. More specifically, the driving gear 20, the first transmission gear 21, the second transmission gear 22, and the clutch body 23 are contained in the lateral area 32B in the gearing 14. A lower end of the first longitudinal area 32C is connected to a front portion of the lateral area 32B from above. The first longitudinal area 32C contains a portion of the shift rod 25 that is positioned higher than its lower end. The second longitudinal area 32D is located at a more rearward position than the first longitudinal area 32C. A lower end of the second longitudinal area 32D is connected to a rear portion of the lateral area 32B from above. The second longitudinal area 32D contains the drive shaft 12.

The oil reservoir chamber 32A contains lubrication oil. The lubrication oil in the present preferred embodiment is gear oil, for example, and is provided at the lateral area 32B, the first longitudinal area 32C, and the second longitudinal area 32D of the oil reservoir chamber 32A. A cooling water passage 32E is provided in the lower case 32. The cooling water passage 32E is placed at a more forward position than the first longitudinal area 32C, and extends in the up-down direction. External water, such as seawater, is taken into the cooling water passage 32E from a water intake (not shown) located in an outer surface of the outboard motor 1, and circulates through the outboard motor 1 so as to cool the engine 11 and the like, and is then discharged outwardly from the outboard motor 1. In the lower case 32, the oil reservoir chamber 32A and the cooling water passage 32E are shut off from each other. Therefore, lubrication oil in the oil reservoir chamber 32A never flows into the cooling water passage 32E, and water in the cooling water passage 32E never flows into the oil reservoir chamber 32A.

The outboard motor 1 includes a lid 36 that is fixed to an upper surface 32F of the lower case 32 by a fastener 35, such as a bolt or the like. The lid 36 is preferably made of metal, such as aluminum. The lid 36 closes the first longitudinal area 32C and the cooling water passage 32E from above. A through hole 36A into which the shift rod 25 is inserted is provided in the lid 36. An annular seal 37 is attached to an upper end of the through hole 36A. The seal 37 closes a gap between an inner peripheral surface of the lid 36 in the through hole 36A and the shift rod 25. Therefore, lubrication oil in the first longitudinal area 32C is prevented from leaking upwardly through the gap. A through hole 32G into which the drive shaft 12 is inserted is provided in the upper surface 32F. A gap between an inner peripheral surface of the lower case 32 in the through hole 32G and the drive shaft 12 is closed with the same seal (not shown) as the seal 37. Therefore, lubrication oil in the second longitudinal area 32D is prevented from leaking upwardly through the gap.

Next, a description will be given of the structure and arrangement to replace lubrication oil in the oil reservoir chamber 32A. The outboard motor 1 includes an oil flow passage 41, an oil flow passage shutoff valve 42, an air flow passage 43, and an air flow passage shutoff valve 44.

The oil flow passage 41 includes a lower oil flow passage 45 provided in the lower case 32, and an upper oil flow passage 46 provided in the upper case 31. The lower oil flow passage 45 is located at a more forward position than the cooling water passage 32E, and extends in the up-down direction in the lower case 32. The lower oil flow passage 45 is provided in the lower case 32 by, for example, casting or drilling. A lower end of the lower oil flow passage 45 is connected to a front end of the lateral area 32B of the oil reservoir chamber 32A. The lower oil flow passage 45 extends to the upper surface 32F of the lower case 32.

Figure 3:
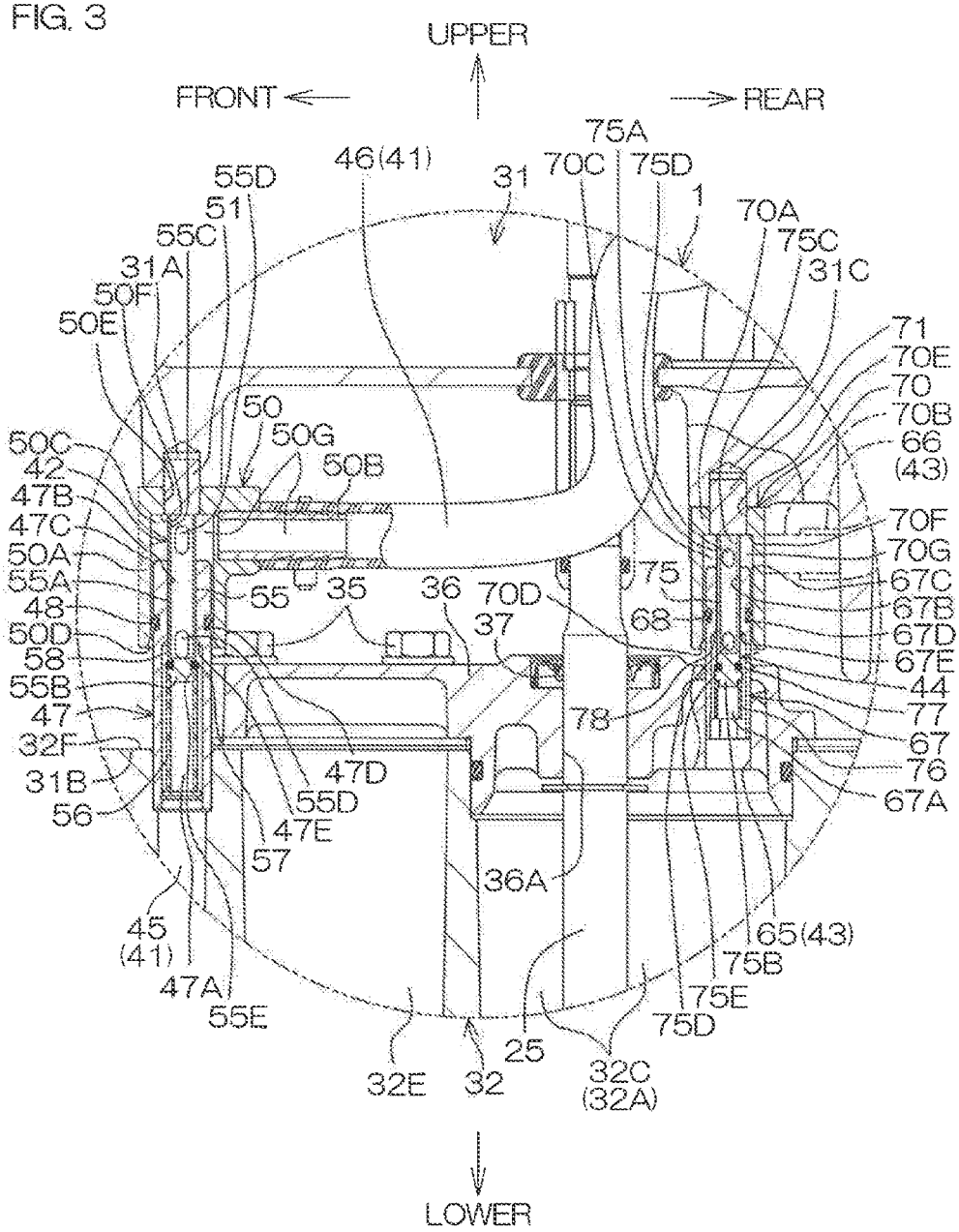
FIG. 3 is an enlarged view of a portion surrounded by a circle of the alternate long and two short dashed line in FIG. 2.

FIG. 3 is an enlarged view of a portion surrounded by a circle of the alternate long and two short dashed line in FIG. 2. A lower oil joint 47 is provided at an upper end of the lower oil flow passage 45. The lower oil joint 47 is preferably made of, for example, metal, and preferably has the shape of a circular or substantially circular pipe that has a central axis extending in the up-down direction. The lower oil joint 47 protrudes upwardly from the upper surface 32F of the lower case 32. A lower end of the lower oil joint 47 is inserted in the upper end of the lower oil flow passage 45. A cylindrical internal space 47A in the lower oil joint 47 defines a portion of the lower oil flow passage 45. A lower oil connection port 47B that opens upwardly is located in an upper end surface of the lower oil joint 47. The lower oil connection port 47B communicates with the internal space 47A of the lower oil joint 47. A chamfer 47C is provided at an outer peripheral edge of the upper end surface of the lower oil joint 47. An annular groove 47D is provided on an outer peripheral surface of a portion protruding upwardly from the upper surface 32F of the lower case 32 in the lower oil joint 47. The groove 47D extends in a circumferential direction of the outer peripheral surface of the lower oil joint 47. An annular seal 48 is fitted in the groove 47D. The seal 48 is an example of first and second seals according to a preferred embodiment of the present invention.

The upper oil flow passage 46 preferably includes a hose made of an elastic material, such as resin or rubber, and extends upwardly from the lower oil joint 47. A middle portion of the upper oil flow passage 46 is fixed to the upper case 31 via a bracket 49 (see FIG. 2). The upper oil flow passage 46 is located inside the casing 16 by being covered with the apron 33 and the like, and is not exposed outwardly from the outboard motor 1. An upper end of the upper oil flow passage 46 is a forward end 46A that is farthest from the oil reservoir chamber 32A in the upper oil flow passage 46 (see FIG. 7 described below).

A lower end that is an end opposite to the forward end 46A in the upper oil flow passage 46 extends forwardly. An upper oil joint 50 is provided at the lower end of the upper oil flow passage 46. The upper oil joint 50 is preferably made of, for example, metal. The upper oil joint 50 includes a tubular longitudinal tube portion 50A that has a central axis extending in the up-down direction, and a tubular lateral tube portion 50B that has a central axis extending in the horizontal direction. The longitudinal tube portion 50A and the lateral tube portion 50B may be mutually different components, or may be integral with each other.

An upper oil connection port 50C defining an internal space of the longitudinal tube portion 50A is provided in the longitudinal tube portion 50A. The upper oil connection port 50C is a cylindrical space that extends in the up-down direction and that passes through the longitudinal tube portion 50A, and opens downwardly in a lower end surface of the longitudinal tube portion 50A. A chamfer 50D is provided at an inner peripheral edge that rims the upper oil connection port 50C in the lower end surface of the longitudinal tube portion 50A. An upper end portion 50E of the upper oil connection port 50C is smaller in diameter than a portion below the upper end portion 50E. Therefore, a flat surface 50F that spreads from a lower end of the upper end portion 50E to the surroundings of the upper end portion 50E is provided in the upper oil joint 50. The lateral tube portion 50B protrudes from the longitudinal tube portion 50A in the horizontal direction. An internal space of the lateral tube portion 50B communicates with a portion below the upper end portion 50E in the upper oil connection port 50C. Consequently, an internal space 50G that bends in the shape of the letter L is defined by the upper oil joint 50. The lateral tube portion 50B is inserted in the lower end of the upper oil flow passage 46. Consequently, the internal space 50G communicates with an internal space of the upper oil flow passage 46, and the upper oil joint 50 defines a portion of the upper oil flow passage 46.

The upper oil joint 50 includes an actuator 51. The actuator 51 is, for example, a cylindrical pin, such as a knock pin. A lower portion of the actuator 51 is provided in the upper end portion 50E of the upper oil connection port 50C, and closes the upper end portion 50E. An upper portion of the actuator 51 protrudes upwardly from the upper end portion 50E. The upper portion of the actuator 51 is inserted in a concave portion 31A provided in the upper case 31. A lower end surface of the actuator 51 is located so as to be flush or substantially flush with the flat surface 50F spreading from the lower end of the upper end portion 50E to the surroundings.

The oil flow passage shutoff valve 42 is built into the lower oil joint 47. In relation to the oil flow passage shutoff valve 42, a valve seat 47E is located between both ends of an inner peripheral surface that defines the internal space 47A in the lower oil joint 47. The valve seat 47E is a tapered surface that becomes thinner as it extends upwardly. In the internal space 47A, an upper portion above the valve seat 47E is smaller in diameter than a lower portion below the valve seat 47E. The oil flow passage shutoff valve 42 includes the valve seat 47E, a valve body 55, an urging member 56, and a seal 57.

The valve body 55 includes a tube portion 55A and a root portion 55B. The tube portion 55A preferably has the shape of a circular or substantially circular tube that has a central axis extending in the up-down direction. An opening 55C that communicates with an internal space of the tube portion 55A and that faces upwardly is provided in an upper end of the tube portion 55A. A lower end of the tube portion 55A is closed. Through holes 55D each of which communicates with the internal space of the tube portion 55A are provided in an upper end and a lower end of an outer peripheral surface of the tube portion 55A, respectively. The root portion 55B is preferably cylindrical or substantially cylindrical, and is coaxially attached to the lower end of the tube portion 55A. An annular flange portion 55E that protrudes from an outer peripheral surface of the root portion 55B is located at a middle portion of the root portion 55B. The tube portion 55A is inserted in the upper portion of the internal space 47A of the lower oil joint 47, and the root portion 55B is located at the lower portion of the internal space 47A. The valve body 55 in this state is slidable upwardly and downwardly in the internal space 47A of the lower oil joint 47, i.e., in the lower oil flow passage 45. In the tube portion 55A, an upper end in which the through hole 55D is provided protrudes higher than the upper end surface of the lower oil joint 47. The flange portion 55E is located at a position lower than the valve seat 47E. At least an outer peripheral portion of the flange portion 55E overlaps with the valve seat 47E when viewed from the up-down direction, i.e., the sliding direction of the valve body 55.

The urging member 56 is, for example, a coil spring that is extensible and contractible in the up-down direction. The urging member 56 is inserted in the lower portion of the internal space 47A of the lower oil joint 47. A lower end of the urging member 56 is fixed to the inner peripheral surface of the lower oil joint 47. An upper end of the urging member 56 is fixed to a portion below the flange portion 55E in the root portion 55B of the valve body 55. The urging member 56 upwardly urges the entirety of the valve body 55 so that the flange portion 55E moves toward the valve seat 47E in a state of being compressed upwardly and downwardly.

The seal 57 is an example of a third seal according to a preferred embodiment of the present invention. The seal 57 is, for example, an annular O-ring, and is attached to a groove portion placed above the flange portion 55E in the root portion 55B of the valve body 55.

The air flow passage 43 includes a lower air flow passage 65 provided in the lower case 32 and an upper air flow passage 66 provided in the upper case 31 (see FIG. 2). The lower air flow passage 65 is located at a more rearward position than the cooling water passage 32E in the lower case 32, and extends in the up-down direction. A lower end of the lower air flow passage 65 is connected to the first longitudinal area 32C of the oil reservoir chamber 32A. The lower air flow passage 65 extends to the lid 36 fixed to the upper surface 32F of the lower case 32.

A lower air joint 67 is provided at an upper end of the lower air flow passage 65. The lower air joint 67 is made of, for example, metal, and preferably has the shape of a circular or substantially circular pipe that has a central axis extending in the up-down direction. The lower air joint 67 passes through the lid 36, and protrudes upwardly from the lid 36. A lower end of the lower air joint 67 is inserted in the upper end of the lower air flow passage 65. A cylindrical internal space 67A in the lower air joint 67 defines a portion of the lower air flow passage 65. A lower air connection port 67B that opens upwardly is located in an upper end surface of the lower air joint 67. The lower air connection port 67B communicates with the internal space 67A of the lower air joint 67. A chamfer 67C is provided at an outer peripheral edge of the upper end surface of the lower air joint 67. An annular groove 67D is provided on an outer peripheral surface of a portion protruding upwardly from the lid 36 in the lower air joint 67. The groove 67D extends in a circumferential direction of the outer peripheral surface of the lower air joint 67.

An annular seal 68 is fitted in the groove 67D.

The upper air flow passage 66 preferably includes a hose made of an elastic material, and extends upwardly from the lower air joint 67. A middle portion of the upper air flow passage 66 is fixed to the upper case 31 via the bracket 49 (see FIG. 2). The upper air flow passage 66 is located inside the casing 16 by being covered with the apron 33 and the like, and is not exposed outwardly from the outboard motor 1. An upper end of the upper air flow passage 66 is a forward end 66A that is farthest from the oil reservoir chamber 32A in the upper air flow passage 66 (see FIG. 7).

An upper air joint 70 is provided at a lower end that is an end opposite to the forward end 66A in the upper air flow passage 66. The upper air joint 70 is made of, for example, metal. The upper air joint 70 includes a tubular longitudinal tube portion 70A that has a central axis extending in the up-down direction, and a tubular lateral tube portion 70B that has a central axis extending in the horizontal direction. The longitudinal tube portion 70A and the lateral tube portion 70B may be mutually different components, or may be integral with each other.

An upper air connection port 70C defining an internal space of the longitudinal tube portion 70A is provided in the longitudinal tube portion 70A. The upper air connection port 70C is a cylindrical or substantially cylindrical space that extends in the up-down direction and that passes through the longitudinal tube portion 70A, and opens downwardly in a lower end surface of the longitudinal tube portion 70A. A chamfer 70D is provided at an inner peripheral edge that rims the upper air connection port 70C in the lower end surface of the longitudinal tube portion 70A. An upper end portion 70E of the upper air connection port 70C is smaller in diameter than a portion below the upper end portion 70E. Therefore, a flat surface 70F that spreads from a lower end of the upper end portion 70E to the surroundings of the upper end portion 70E is provided in the upper air joint 70. The lateral tube portion 70B protrudes from the longitudinal tube portion 70A in the horizontal direction. An internal space of the lateral tube portion 70B communicates with a portion below the upper end portion 70E in the upper air connection port 70C. Consequently, an internal space 70G that bends in the shape of the letter L is defined in the upper air joint 70. The lateral tube portion 70B is inserted in the lower end of the upper air flow passage 66. Consequently, the internal space 70G communicates with an internal space of the upper air flow passage 66, and the upper air joint 70 defines a portion of the upper air flow passage 66.

The upper air joint 70 includes an actuator 71. The actuator 71 is, for example, a cylindrical pin, such as a knock pin. A lower portion of the actuator 71 is provided in the upper end portion 70E of the upper air connection port 70C, and closes the upper end portion 70E. An upper portion of the actuator 71 protrudes upwardly from the upper end portion 70E. The upper portion of the actuator 71 is inserted in a concave portion 31C provided in the upper case 31. A lower end surface of the actuator 71 is located so as to be flush or substantially flush with the flat surface 70F spreading from the lower end of the upper end portion 70E to the surroundings.

The air flow passage shutoff valve 44 is built into the lower air joint 67. In relation to the air flow passage shutoff valve 44, a valve seat 67E is located between both ends of an inner peripheral surface that defines the internal space 67A in the lower air joint 67. The valve seat 67E is a tapered surface that becomes thinner as it extends upwardly. In the internal space 67A, an upper portion above the valve seat 67E is smaller in diameter than a lower portion below the valve seat 67E. The air flow passage shutoff valve 44 includes the valve seat 67E, a valve body 75, an urging member 76, and a seal 77.

The valve body 75 includes a tube portion 75A and a root portion 75B. The tube portion 75A preferably has the shape of a circular or substantially circular tube that has a central axis extending in the up-down direction. An opening 75C that communicates with an internal space of the tube portion 75A and that faces upwardly is provided in an upper end of the tube portion 75A. A lower end of the tube portion 75A is closed. Through holes 75D each of which communicates with the internal space of the tube portion 75A are located in an upper end and a lower end of an outer peripheral surface of the tube portion 75A, respectively. The root portion 75B is preferably cylindrical or substantially cylindrical, and is coaxially attached to the lower end of the tube portion 75A. An annular flange portion 75E that protrudes from an outer peripheral surface of the root portion 75B is located at a middle portion of the root portion 75B. The tube portion 75A is inserted in the upper portion of the internal space 67A of the lower air joint 67, and the root portion 75B is located at the lower portion of the internal space 67A. The valve body 75 in this state is slidable upwardly and downwardly in the internal space 67A of the lower air joint 67, i.e., in the lower air flow passage 65. In the tube portion 75A, an upper end in which the through hole 75D is provided protrudes higher than the upper end surface of the lower air joint 67. The flange portion 75E is located at a position lower than the valve seat 67E. At least an outer peripheral portion of the flange portion 75E overlaps with the valve seat 67E when viewed from the up-down direction, i.e., the sliding direction of the valve body 75.

The urging member 76 is, for example, a coil spring that is extensible and contractible in the up-down direction. The urging member 76 is inserted in the lower portion of the internal space 67A of the lower air joint 67. A lower end of the urging member 76 is fixed to the inner peripheral surface of the lower air joint 67. An upper end of the urging member 76 is fixed to a portion below the flange portion 75E in the root portion 75B of the valve body 75. The urging member 76 upwardly urges the entirety of the valve body 75 so that the flange portion 75E moves toward the valve seat 67E in a state of being compressed upwardly and downwardly.

The seal 77 is, for example, an annular O-ring, and is attached to a groove portion placed above the flange portion 75E in the root portion 75B of the valve body 75.

The upper surface 32F of the lower case 32 is in contact with the lower surface 31B of the upper case 31 in a state in which the lower case 32 has been attached to the upper case 31 as shown in FIG. 3. Additionally, the lower oil joint 47 is joined to the upper oil joint 50 by being inserted into the upper oil connection port 50C of the upper oil joint 50 from below. The lower oil connection port 47B of the lower oil joint 47 is connected to the upper oil connection port 50C. A gap between the outer peripheral surface of the lower oil joint 47 and the inner peripheral surface of the upper oil joint 50, i.e., between the outer peripheral surface of the lower oil joint 47 and an inner surface of the upper oil flow passage 46 is closed with the seal 48.

In this state, the valve body 55 of the oil flow passage shutoff valve 42 is brought into contact with the lower end surface of the actuator 51 in the upper oil connection port 50C, and is downwardly pushed by the actuator 51. Consequently, the flange portion 55E of the valve body 55 is spaced downwardly from the valve seat 47E, and therefore a gap 58 is created between the flange portion 55E and the valve seat 47E. In other words, the oil flow passage shutoff valve 42 is in an open state, and the actuator 51 is in a state of opening the oil flow passage shutoff valve 42. The lower oil flow passage 45 and the upper oil flow passage 46 communicate with each other via the gap 58, the internal space of the tube portion 55A of the valve body 55, and the upper and lower through holes 55D in the tube portion 55A. In other words, in a state in which the lower case 32 has been attached to the upper case 31, the oil flow passage shutoff valve 42 is subjected to an opening operation by the actuator 51, and hence opens the lower oil flow passage 45, and allows the lower oil flow passage 45 and the upper oil flow passage 46 to communicate with each other. Consequently, the oil flow passage 41 is completed, and reaches an open state over its entire area.

Additionally, in a state in which the lower case 32 has been attached to the upper case 31, the lower air joint 67 is joined to the upper air joint 70 by being inserted into the upper air connection port 70C of the upper air joint 70 from below. The lower air connection port 67B of the lower air joint 67 is connected to the upper air connection port 70C. A gap between the outer peripheral surface of the lower air joint 67 and the inner peripheral surface of the upper air joint 70, i.e., between the outer peripheral surface of the lower air joint 67 and an inner surface of the upper air flow passage 66 is closed with the seal 68.

In this state, the valve body 75 of the air flow passage shutoff valve 44 is brought into contact with the lower end surface of the actuator 71 in the upper air connection port 70C, and is downwardly pushed by the actuator 71. Consequently, the flange portion 75E of the valve body 75 is spaced downwardly from the valve seat 67E, and therefore a gap 78 is created between the flange portion 75E and the valve seat 67E. In other words, the air flow passage shutoff valve 44 is in an open state, and the actuator 71 is in a state of opening the air flow passage shutoff valve 44. The lower air flow passage 65 and the upper air flow passage 66 communicate with each other via the gap 78, the internal space of the tube portion 75A of the valve body 75, and the upper and lower through holes 75D in the tube portion 75A. In other words, in a state in which the lower case 32 has been attached to the upper case 31, the air flow passage shutoff valve 44 is subjected to an opening operation by the actuator 71, and hence opens the lower air flow passage 65, and allows the lower air flow passage 65 and the upper air flow passage 66 to communicate with each other. Consequently, the air flow passage 43 is completed, and reaches an open state over its entire area.

Figure 4:
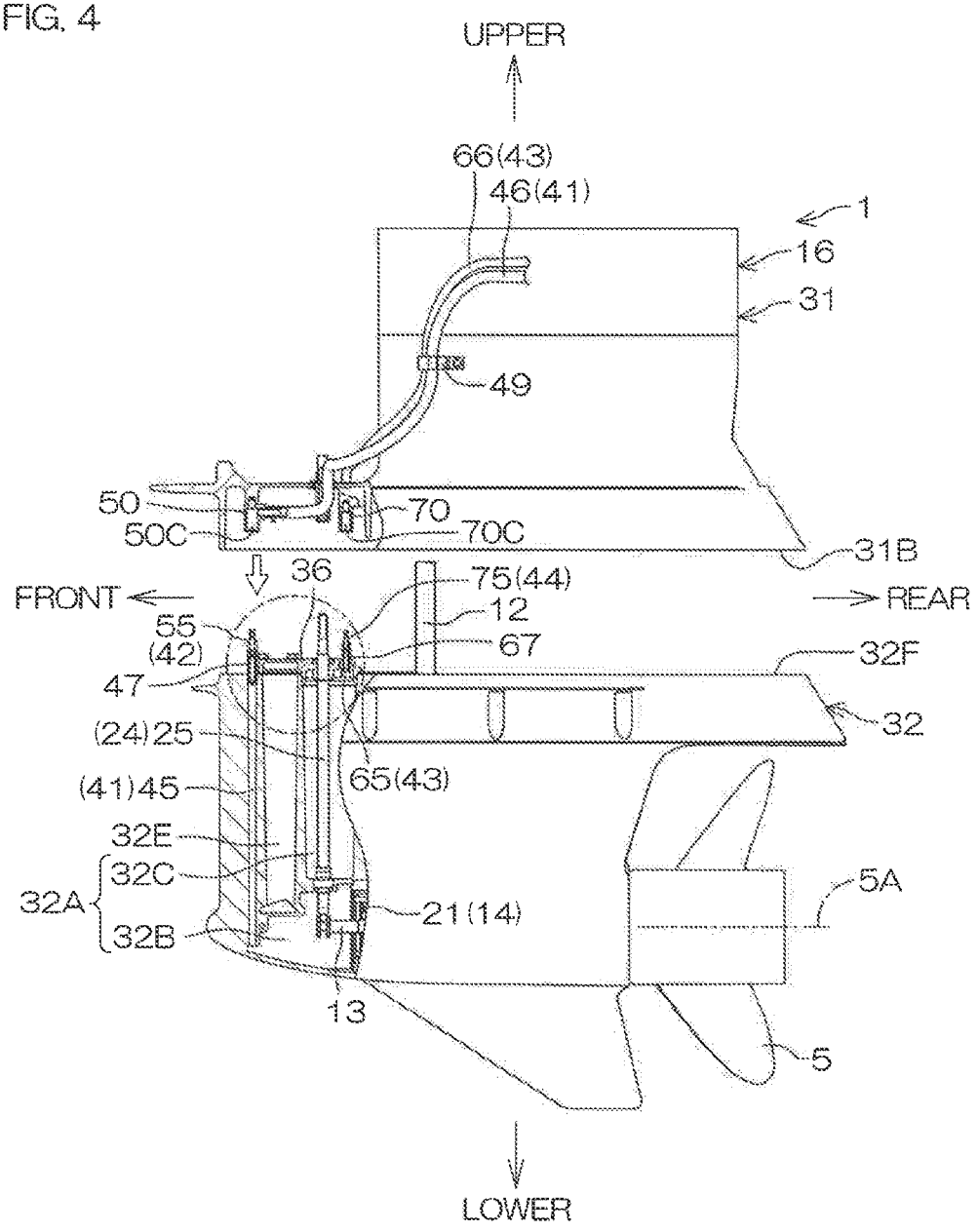
FIG. 4 is a partial cross-sectional view showing the left side of the upper case and the left side of the lower case that has been detached from the upper case.

The operator loosens the fastener 34 (see FIG. 2) for maintenance or the like, and detaches the lower case 32 downwardly from the upper case 31 as indicated by the outlined arrow of FIG. 4. Thereupon, the lower oil joint 47 comes off downwardly from the inside of the upper oil connection port 50C of the upper oil joint 50 together with the valve body 55 of the oil flow passage shutoff valve 42. Additionally, the lower air joint 67 comes off downwardly from the inside of the upper air connection port 70C of the upper air joint 70 together with the valve body 75 of the air flow passage shutoff valve 44. Consequently, the oil flow passage 41 is separated into the lower oil flow passage 45 and the upper oil flow passage 46, and the air flow passage 43 is separated into the lower air flow passage 65 and the upper air flow passage 66.

Figure 5:
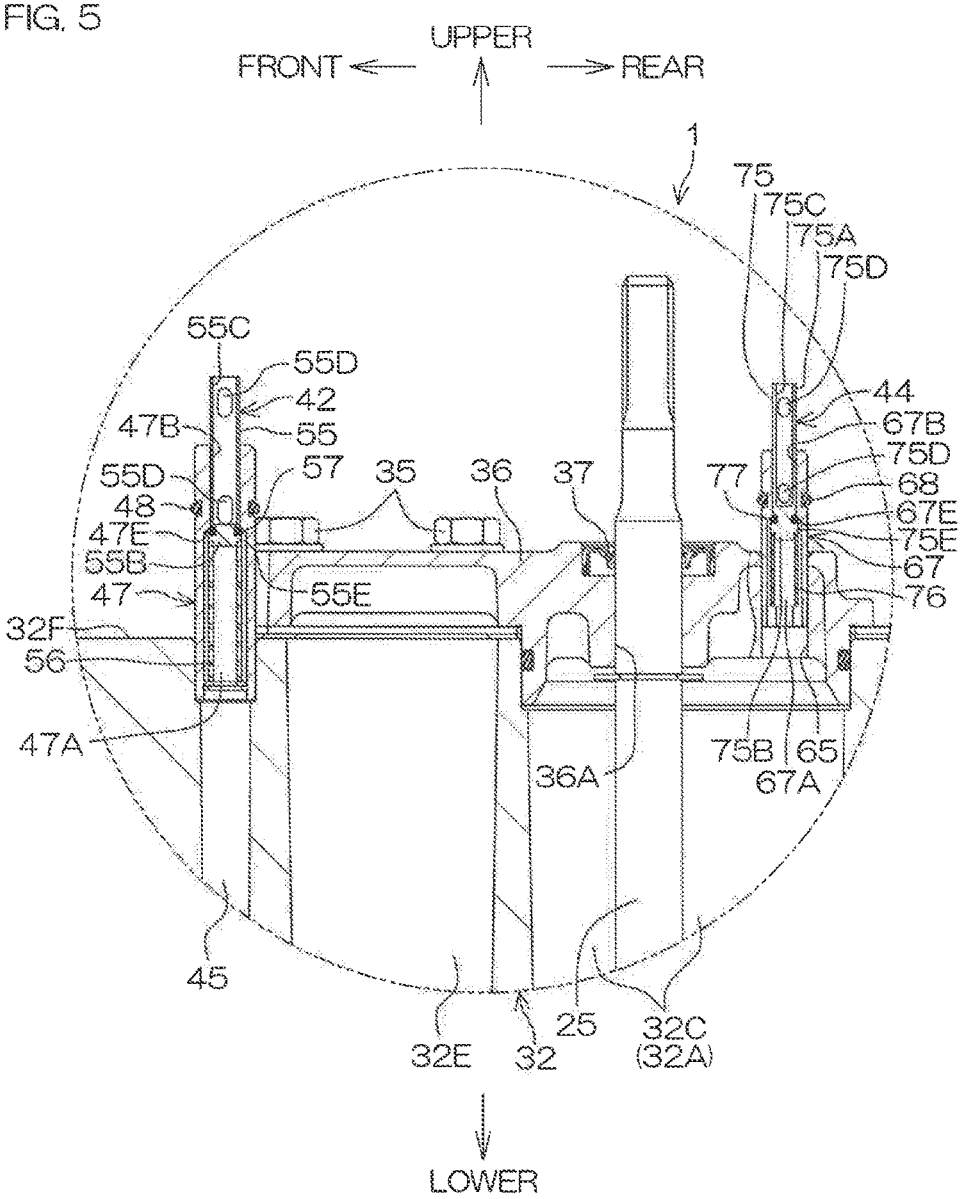
FIG. 5 is an enlarged view of a portion surrounded by a circle of the alternate long and two short dashed line in FIG. 4.

FIG. 5 is an enlarged view of a portion surrounded by a circle of the alternate long and two short dashed line in FIG. 4. When the lower case 32 is thus detached from the upper case 31, the valve body 55 of the oil flow passage shutoff valve 42 is separated downwardly from the actuator 51 in the upper oil connection port 50C. Consequently, the opening operation state of the actuator 51 is released, and therefore the valve body 55 is raised by the urging of the urging member 56, and the flange portion 55E of the valve body 55 approaches the valve seat 47E, and is received by the valve seat 47E in the oil flow passage shutoff valve 42. Thereupon, the seal 57 of the valve body 55 is compressed between the flange portion 55E and the valve seat 47E, and the gap 58 (see FIG. 3) between the flange portion 55E and the valve seat 47E is closed, and hence disappears. Therefore, the lower oil flow passage 45 is shut off at the seal 57. In other words, the oil flow passage shutoff valve 42 closes the lower oil flow passage 45 in a state in which the lower case 32 has been detached from the upper case 31.

Additionally, when the lower case 32 is detached from the upper case 31, the valve body 75 of the air flow passage shutoff valve 44 is separated downwardly from the actuator 71 in the upper air connection port 70C. Consequently, the opening operation state of the actuator 71 is released, and therefore the valve body 75 is raised by the urging of the urging member 76, and the flange portion 75E of the valve body 75 approaches the valve seat 67E, and is received by the valve seat 67E in the air flow passage shutoff valve 44. Thereupon, the seal 77 of the valve body 75 is compressed between the flange portion 75E and the valve seat 67E, and the gap 78 (see FIG. 3) between the flange portion 75E and the valve seat 67E is closed, and hence disappears. Therefore, the lower air flow passage 65 is shut off at the seal 77. In other words, the air flow passage shutoff valve 44 closes the lower air flow passage 65 in a state in which the lower case 32 has been detached from the upper case 31.

Figure 6:
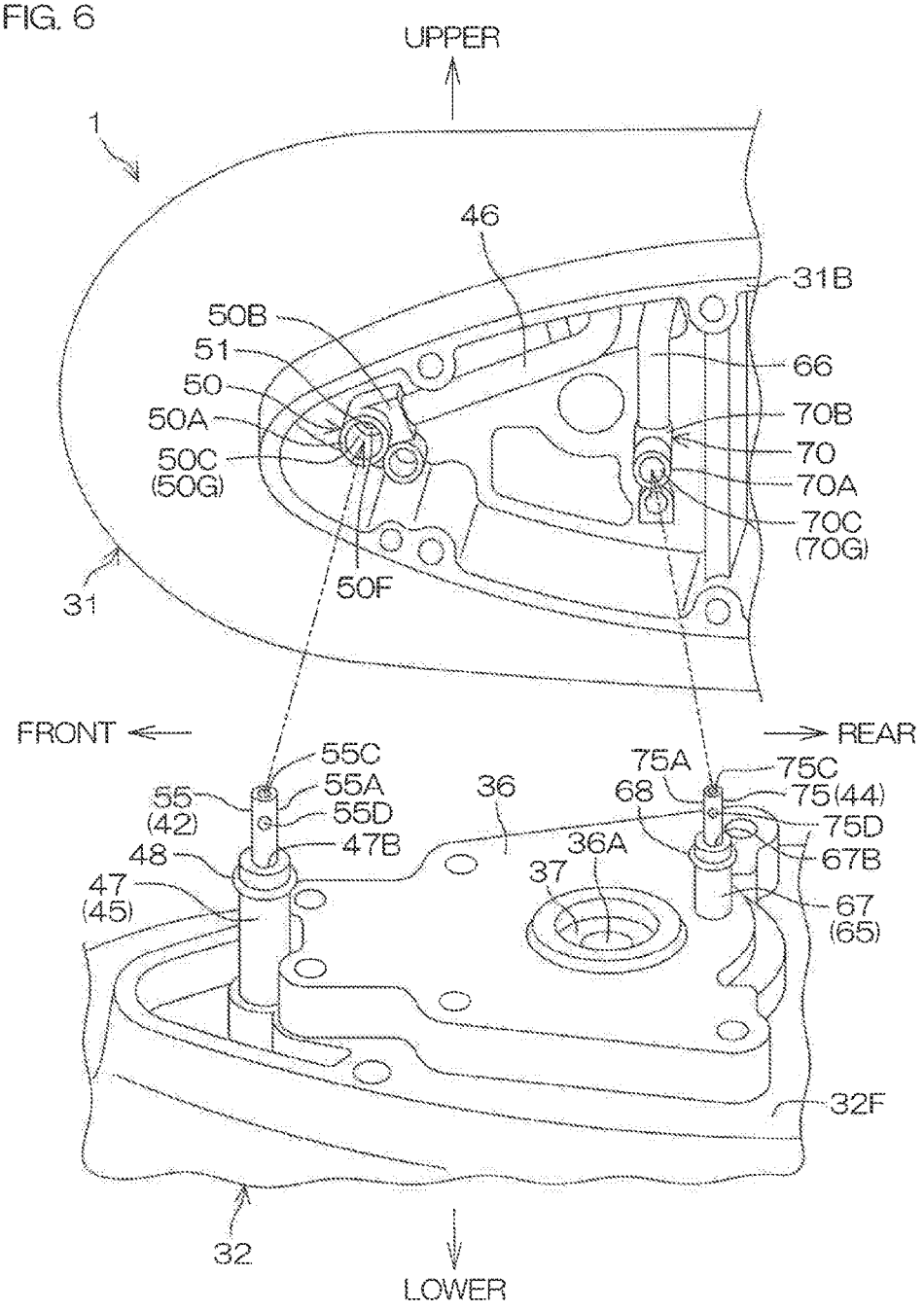
FIG. 6 is a schematic exploded perspective view showing the upper case and the lower case that has been detached from the upper case.

FIG. 6 is a schematic exploded perspective view showing the upper case 31 and the lower case 32 that has been detached from the upper case 31. The operator who has finished maintenance or the like raises the lower case 32 to approach the upper case 31, and attaches the lower case 32 to the upper case 31. At that time, the lower oil joint 47 is inserted into the upper oil connection port 50C of the upper oil joint 50 from below together with the valve body 55 of the oil flow passage shutoff valve 42. Additionally, the lower air joint 67 is inserted into the upper air connection port 70C of the upper air joint 70 from below together with the valve body 75 of the air flow passage shutoff valve 44. Consequently, when the lower case 32 is completely attached to the upper case 31, the oil flow passage shutoff valve 42 opens the lower oil flow passage 45, and the air flow passage shutoff valve 44 opens the lower air flow passage 65 as described above (see FIG. 3). As thus described, the oil flow passage 41 and the air flow passage 43 are completed merely by inserting the lower oil joint 47 and the lower air joint 67 into the upper oil connection port 50C and the upper air connection port 70C, respectively. Therefore, it is possible to improve the operation efficiency of maintenance performed by the operator.

Figure 7:
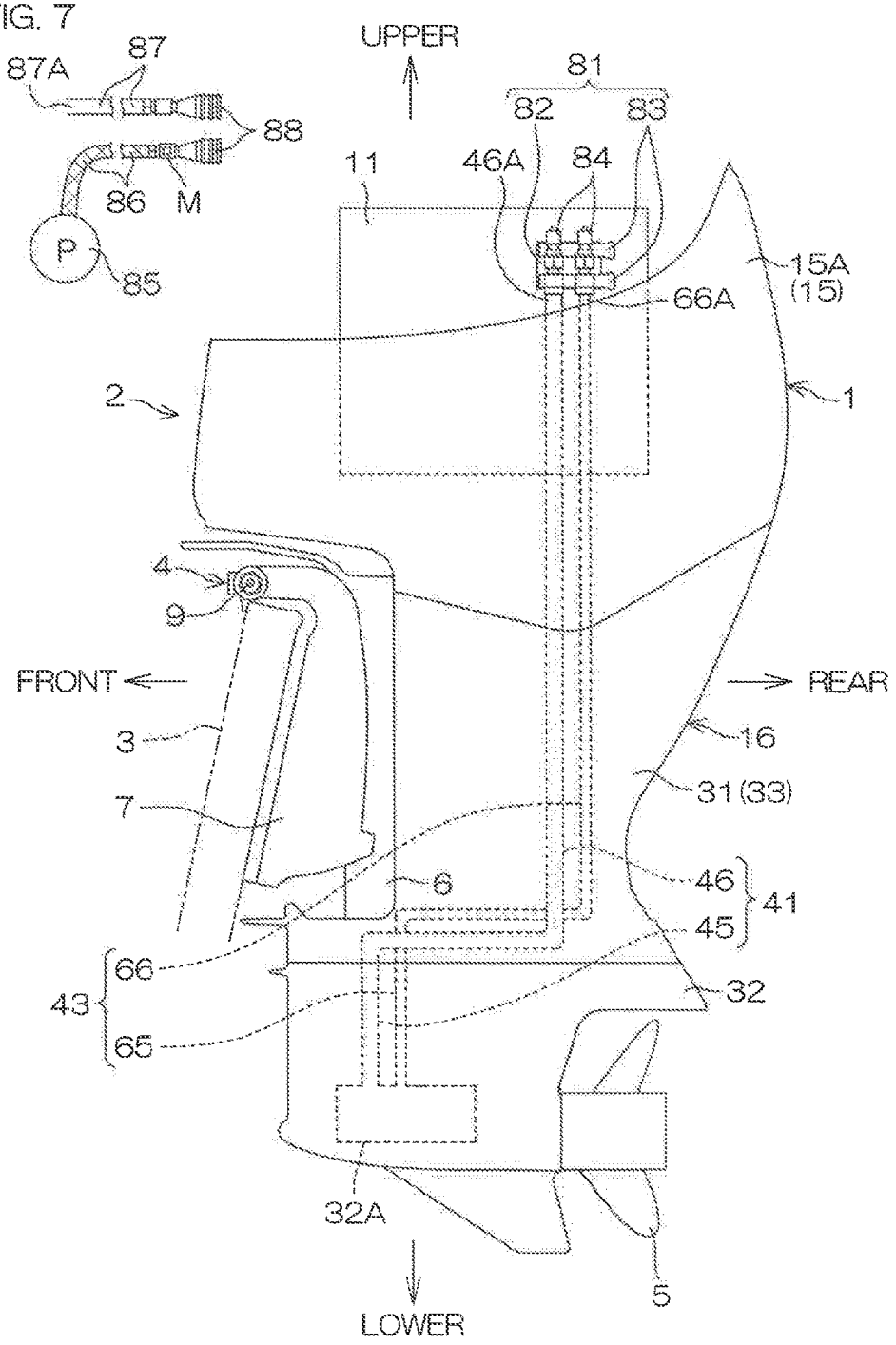
FIG. 7 is a schematic view to describe an oil replacement method according to a preferred embodiment of the present invention.
Figure 8:
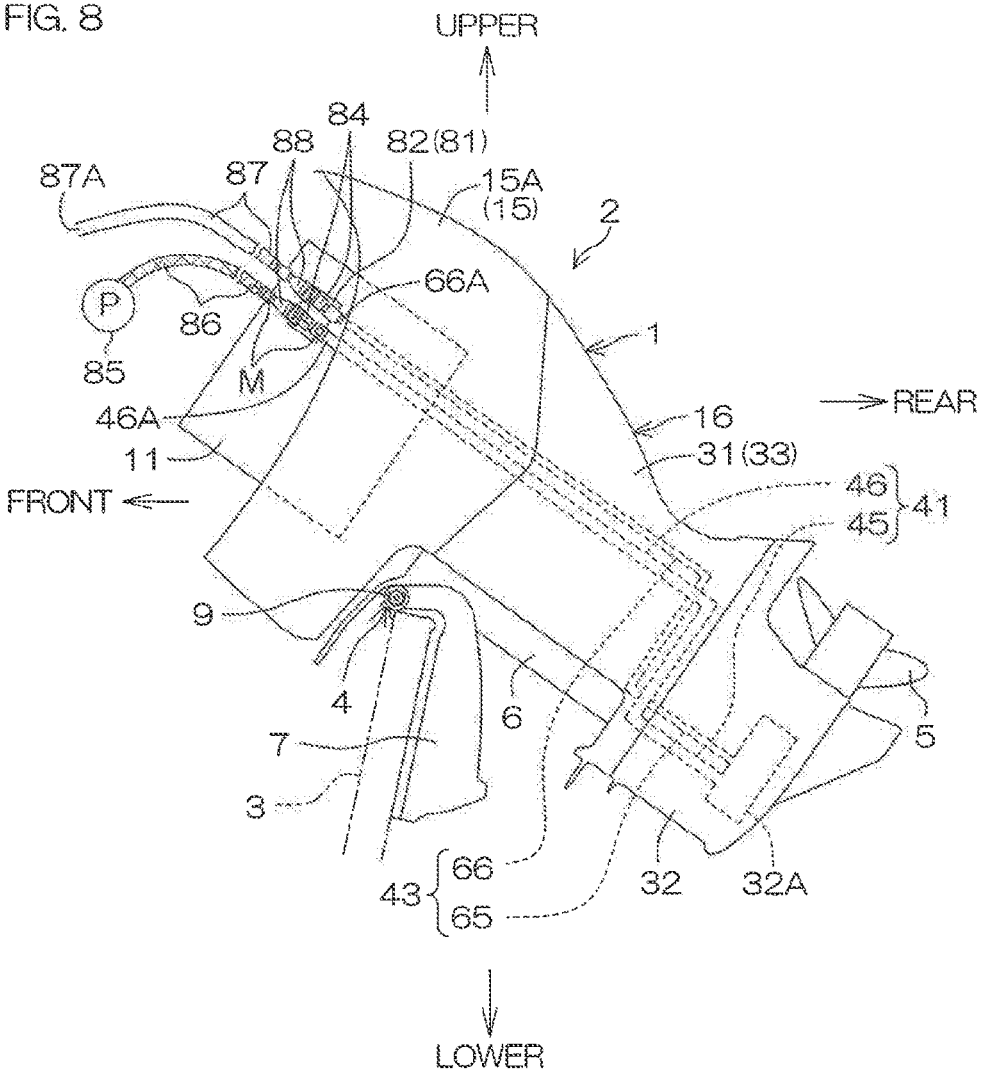
FIG. 8 is a schematic view to describe an oil replacement method according to a preferred embodiment of the present invention.

Next, a description will be given of a procedure for replacing lubrication oil in the oil reservoir chamber 32A with reference to FIG. 7 and FIG. 8. The operator performs an operation to replace lubrication oil while standing near the outboard motor 1 in the hull 3. More specifically, in a state in which the outboard motor 1 is in the tilt-down position, the operator detaches the top cover 15B (see FIG. 1) of the engine cover 15 from the bottom cover 15A. Thereupon, the inside of the engine cover 15 is opened upwardly, and an upper portion of the engine 11 is exposed together with the forward end 46A of the upper oil flow passage 46 and the forward end 66A of the upper air flow passage 66 as shown in FIG. 7. The forward ends 46A and 66A are located separately from the tilting shaft 9, at a higher and more rearward position than the tilting shaft 9. The forward ends 46A and 66A are separated from and are located more rearwardly than the steering shaft 8, the drive shaft 12, and the crankshaft 18 (see FIG. 1). The forward ends 46A and 66A are each located at a higher position than an upper end of the drive shaft 12.

The outboard motor 1 includes a holding member 81 that holds the forward ends 46A and 66A. The holding member 81 includes, for example, a plate-shaped base portion 82, and a belt-shaped band portion 83 attached to the base portion 82. The base portion 82 is fixed to a side surface (left side surface in FIG. 7) of the engine 11. An end (front end in FIG. 7) of the band portion 83 is attached to the base portion 82. The band portion 83 is openable and closable by turning around this end. The forward ends 46A and 66A are held in the side surface of the engine 11 by being sandwiched between the closed band portion 83 and the base portion 82. The operator operates the PTT 10 by operating the up/down switch, and turns the outboard motor 1 to the tilt-up position shown in FIG. 8. The outboard motor 1 may be turned to the tilt-up position before the top cover 15B is detached.

With the outboard motor 1 being in the tilt-up position, the forward end 46A of the upper oil flow passage 46 and the forward end 66A of the upper air flow passage 66 are located at a height at which the hands of the operator standing in the vessel easily reach the forward ends 46A and 66A. The operator grips and opens the band portion 83, and detaches and frees the forward ends 46A and 66A from the base portion 82. The forward end 46A and the forward end 66A are provided with couplers 84, respectively. A manual or electrically-operated pump 85, an oil hose 86, and an air hose 87 are prepared in order to replace lubrication oil. The pump 85, the oil hose 86, and the air hose 87 are examples of external equipment for lubrication oil replacement according to a preferred embodiment of the present invention. The pump 85 is located inside the vessel. The oil hose 86 extends from the pump 85. The oil hose 86 and the air hose 87 are transparent or semitransparent hoses, respectively. An opening 87A to open the internal space of the air hose 87 to the atmosphere is located at an end opposite to a forward end in the air hose 87.

A forward end of the oil hose 86 and the forward end of the air hose 87 are provided with couplers 88, respectively. As an example, the coupler 84 is a male coupler, and the coupler 88 is a female coupler. It is possible to use publicly known couplers that make a one-touch connection as the coupler 84 and as the coupler 88. The coupler 84 that has not been connected to the coupler 88 closes the upper oil flow passage 46 and the upper air flow passage 66. The coupler 88 that has not been connected to the coupler 84 closes the oil hose 86 and the air hose 87.

The operator connects the coupler 88 of the oil hose 86 to the coupler 84 of the upper oil flow passage 46 in a one-touch connection manner. More specifically, the operator inserts the coupler 84 into the coupler 88, and then slides an outer peripheral portion of the coupler 88 toward the upper oil flow passage 46. Consequently, the upper oil flow passage 46 is connected to the pump 85 via the oil hose 86. The operator connects the coupler 88 of the air hose 87 to the coupler 84 of the upper air flow passage 66 in a one-touch connection manner according to the same procedure as above. Consequently, the internal space of the upper air flow passage 66 is connected to the internal space of the air hose 87, and is opened from the opening 87A of the air hose 87 to the atmosphere. Marks M (for example, a stamped "OIL") that are used to distinguish the couplers 84 and 88 for lubrication oil from the couplers 84 and 88 for air may be displayed on the couplers 84 and 88 for lubrication oil, respectively.

The coupler 88 is connected to the coupler 84, and then the operator operates the pump 85. Thereupon, used lubrication oil in the oil reservoir chamber 32A of the lower case 32 is sucked by the pump 85. Therefore, the used lubrication oil flows through the lower oil flow passage 45 and the upper oil flow passage 46 of the oil flow passage 41, and is then discharged outwardly from the outboard motor 1, and is then allowed to flow through the oil hose 86, and is gathered in a waste oil tank (not shown). In other words, when lubrication oil in the oil reservoir chamber 32A is replaced, the oil flow passage 41 guides used lubrication oil to the outside of the outboard motor 1. At that time, air outside the outboard motor 1 flows from the opening 87A of the air hose 87 into the oil reservoir chamber 32A through the upper air flow passage 66 and through the lower air flow passage 65. Air thus flows into the oil reservoir chamber 32A instead of lubrication oil flows out from the oil reservoir chamber 32A, and, as a result, lubrication oil in the oil reservoir chamber 32A is continuously sucked by the pump 85.

When air bubbles mix with lubrication oil flowing through the oil hose 86, the operator understands that all of or almost all of the lubrication oil has been discharged from the oil reservoir chamber 32A. Thereafter, the operator connects an oil tank (not shown) that contains new lubrication oil to the pump 85, and operates the pump 85. Thereupon, new lubrication oil flows through the oil hose 86 and through the lower oil flow passage 45 and the upper oil flow passage 46 of the oil flow passage 41, and is supplied into the oil reservoir chamber 32A. In other words, when lubrication oil in the oil reservoir chamber 32A is replaced, the oil flow passage 41 guides new lubrication oil to the oil reservoir chamber 32A. At that time, air in the oil reservoir chamber 32A flows through the lower air flow passage 65, the upper air flow passage 66, and the air hose 87, and is discharged from the opening 87A of the air hose 87 to the atmosphere. When a predetermined amount of lubrication oil is supplied to the oil reservoir chamber 32A, excessive lubrication oil flows through the lower air flow passage 65, the upper air flow passage 66, and the air hose 87, and is discharged from the opening 87A of the air hose 87. Consequently, the operator understands that a predetermined amount of lubrication oil has been supplied to the oil reservoir chamber 32A. Lubrication oil discharged from the opening 87A of the air hose 87 may be returned to the lubricating oil tank. The pump 85 may be divided into a pump to suck used lubrication oil from the oil reservoir chamber 32A and another pump to supply new lubrication oil into the oil reservoir chamber 32A.

A predetermined amount of lubrication oil is supplied to the oil reservoir chamber 32A, and then the operator detaches the coupler 88 of the oil hose 86 from the coupler 84 of the upper oil flow passage 46, and detaches the coupler 88 of the air hose 87 from the coupler 84 of the upper air flow passage 66. More specifically, the operator slides the outer peripheral portion of the coupler 88 so as to be separated from the upper oil flow passage 46 and from the upper air flow passage 66, and then draws out the coupler 84 from the inside of the coupler 88. Thereafter, the operator closes the band portion 83 (see FIG. 7), and fixes the forward end 46A of the upper oil flow passage 46 and the forward end 66A of the upper air flow passage 66 to the holding member 81. Finally, the operator turns the outboard motor 1 from the tilt-up position to the tilt-down position by operating the up/down switch, and attaches the top cover 15B to the bottom cover 15A, and, at this time, the replacement operation of lubrication oil in the oil reservoir chamber 32A is finished. The outboard motor 1 may be turned to the tilt-down position before attaching the top cover 15B or after attaching the top cover 15B.

The cross-sectional area of the flow passage of each portion in the oil flow passage 41 is larger than the cross-sectional area of the flow passage of each portion in the air flow passage 43 and in the air hose 87. This enables lubrication oil whose viscosity is higher than air to smoothly flow through the oil flow passage 41 even if the pump pressure of the pump 85 is small. Because of the same effect, the cross-sectional area of the flow passage of the oil hose 86 is larger than the cross-sectional area of the flow passage of each portion in the air flow passage 43 and in the air hose 87.

As described above, the oil flow passage shutoff valve 42 opens the lower oil flow passage 45 in a state in which the lower case 32 has been attached to the upper case 31, and therefore the upper oil flow passage 46 and the lower oil flow passage 45 are connected to each other, and the oil flow passage 41 reaches an open state. This makes it possible to replace lubrication oil in the oil reservoir chamber 32A by the oil flow passage 41. On the other hand, in a state in which the lower case 32 has been detached from the upper case 31, the oil flow passage 41 is divided into the upper oil flow passage 46 and the lower oil flow passage 45, and the oil flow passage shutoff valve 42 closes the lower oil flow passage 45. This makes it possible to prevent lubrication oil in the oil reservoir chamber 32A from flowing out from the lower case 32 through the lower oil flow passage 45. Therefore, it is possible to prevent lubrication oil from leaking out from the detachable lower case 32.

In the present preferred embodiment, the lower oil joint 47 of the lower oil flow passage 45 and the upper oil joint 50 of the upper oil flow passage 46 are joined together when the lower case 32 is attached to the upper case 31. Consequently, the actuator 51 of the upper oil joint 50 applies an opening operation to the oil flow passage shutoff valve 42 built into the lower oil joint 47, and the oil flow passage shutoff valve 42 opens the lower oil flow passage 45. On the other hand, when the lower case 32 is detached from the upper case 31, the connection between the lower oil joint 47 and the upper oil joint 50 is released. Consequently, the actuator 51 does not apply an opening operation to the oil flow passage shutoff valve 42, and therefore the oil flow passage shutoff valve 42 closes the lower oil flow passage 45. It is possible to realize the opening and closing of the lower oil flow passage 45 with the oil flow passage shutoff valve 42 in conjunction with the connection or disconnection between the lower oil joint 47 and the upper oil joint 50 in response to the attaching or detaching of the lower case 32 to or from the upper case 31 as thus described.

In the present preferred embodiment, the valve body 55 of the oil flow passage shutoff valve 42 is downwardly pushed by the actuator 51 in the upper oil connection port 50C of the upper oil joint 50 when the lower case 32 is attached to the upper case 31. Consequently, the gap 58 that allows the upper oil flow passage 46 and the lower oil flow passage 45 to communicate with each other is created between the valve body 55 and the valve seat 47E in the oil flow passage shutoff valve 42. Therefore, it is possible to realize the opening action of the lower oil flow passage 45 by the oil flow passage shutoff valve 42. On the other hand, when the lower case 32 is detached from the upper case 31, the valve body 55 is not pushed by the actuator 51, and the valve body 55 that is raised by the urging of the urging member 56 approaches the valve seat 47E in the oil flow passage shutoff valve 42. Consequently, the gap 58 that allows the upper oil flow passage 46 and the lower oil flow passage 45 to communicate with each other closes, and therefore it is possible to realize the closing action of the lower oil flow passage 45 with the oil flow passage shutoff valve 42.

In the present preferred embodiment, the lower oil joint 47 is inserted in the upper oil connection port 50C in a state in which the oil flow passage shutoff valve 42 has opened the lower oil flow passage 45. Consequently, the lower oil connection port 47B of the lower oil joint 47 is connected to the upper oil connection port 50C in the upper oil flow passage 46. This makes it possible to prevent lubrication oil in the oil flow passage 41 from leaking out from a joint between the lower oil connection port 47B and the upper oil connection port 50C because the joint reaches an unexposed state to the outside of the oil flow passage 41 that has been opened.

In the present preferred embodiment, the seal 48 prevents lubrication oil in the oil flow passage 41 from leaking out from the gap between the lower oil joint 47 and the inner surface of the upper oil flow passage 46. A plurality of seals 48 may be provided without being limited to the single seal 48. The same applies to the other seal 68.

In the present preferred embodiment, the seal 57 is compressed between the valve body 55 and the valve seat 47E, and closes the gap 58 between the valve body 55 and the valve seat 47E in a state in which the lower case 32 has been detached from the upper case 31. This enables the oil flow passage shutoff valve 42 to close the lower oil flow passage 45. The seal 57 can be excluded if the valve body 55 comes into contact with the valve seat 47E and hence closes the gap 58 in the oil flow passage shutoff valve 42. The same applies to the seal 77 of the air flow passage shutoff valve 44.

In the present preferred embodiment, atmospheric air flows into the oil reservoir chamber 32A through the upper air flow passage 66 and the lower air flow passage 65 when used lubrication oil in the oil reservoir chamber 32A is discharged outwardly from the outboard motor 1 through the oil flow passage 41 during lubrication oil replacement in the oil reservoir chamber 32A. Lubrication oil and air change places with each other in the oil reservoir chamber 32A, and, as a result, it is possible to smoothly discharge used lubrication oil from the oil reservoir chamber 32A. On the other hand, when new lubrication oil flows into the oil reservoir chamber 32A through the oil flow passage 41, air in the oil reservoir chamber 32A is discharged outwardly from the outboard motor 1 through the lower air flow passage 65 and through the upper air flow passage 66. Lubrication oil and air change places with each other in the oil reservoir chamber 32A, and, as a result, it is possible to smoothly add new lubrication oil to the oil reservoir chamber 32A.

In the present preferred embodiment, the air flow passage shutoff valve 44 opens the lower air flow passage 65 in a state in which the lower case 32 has been attached to the upper case 31, and therefore the upper air flow passage 66 and the lower air flow passage 65 are connected to each other, and the air flow passage 43 is opened, and is brought into an open state to the atmosphere. Therefore, lubrication oil and air change places with each other in the oil reservoir chamber 32A during lubrication oil replacement, and therefore it is possible to smoothly discharge used lubrication oil from the oil reservoir chamber 32A and is possible to smoothly add new lubrication oil to the oil reservoir chamber 32A. On the other hand, the air flow passage shutoff valve 44 closes the lower air flow passage 65 in a state in which the lower case 32 has been detached from the upper case 31. This makes it possible to prevent lubrication oil in the oil reservoir chamber 32A from flowing out from the lower case 32 through the lower air flow passage 65. Therefore, it is possible to prevent lubrication oil from leaking out from the detachable lower case 32.

In the present preferred embodiment, the lower case 32 is detached from the upper case 31 together with the drive shaft 12. It is supposed that the outboard motor 1 will be transported in a state in which the upper case 31 and the lower case 32 have been detached from each other, and, at that time, the lower case 32 will be tilted so that the drive shaft 12 lies down. In this situation, it is possible to prevent lubrication oil from leaking out from the lower case 32.

Additionally, the structure including the drive shaft 12 and the lower case 32 is bulky in the longitudinal direction of the drive shaft 12. Therefore, in a state in which the outboard motor 1 is in the tilt-down position, this structure is bulky in the up-down direction because the drive shaft 12 is long in the upward and downward directions. In this state, the work of pulling out the drive shaft 12 from the upper case 31 by moving the lower case 32 downwardly for detachment or the work of inserting the drive shaft 12 into the upper case 31 by moving the lower case 32 upwardly for attachment is a great laborious effort. Therefore, if the outboard motor 1 is placed in a tilted attitude so that the drive shaft 12 tilts with respect to the perpendicular direction, the operator is able to easily perform the attaching or detaching operation of the lower case 32. Therefore, before attaching or detaching the lower case 32, the operator operates the up/down switch (not shown), and turns the outboard motor 1 from the tilt-down position so that the drive shaft 12 tilts with respect to the perpendicular direction. Although the lower case 32 is in a tilted state in the outboard motor 1 that has been turned, it is possible to prevent lubrication oil from leaking out from the lower case 32 by the oil flow passage shutoff valve 42 and the air flow passage shutoff valve 44 even if the lower case 32 is attached or detached in that state.

In the present preferred embodiment, the forward end 46A of the upper oil flow passage 46 is located at a position that is easily accessed by the operator when the outboard motor 1 is turned to the tilt-up position. The coupler 84 provided at the forward end 46A is allowed to make a one-touch connection with the coupler 88 of the oil hose 86 that is an external device for lubrication oil replacement. Therefore, it is possible to perform a lubrication oil replacement operation in a standing attitude by allowing the operator to turn the outboard motor 1 to the tilt-up position and to connect the coupler 84 to the coupler 88 in a one-touch connection manner.

Other Preferred Embodiments

Although preferred embodiments of the present invention have been described above, the present invention is not restricted to the preferred embodiments described above, and various modifications are possible within the scope of the present invention.

Figure 9:
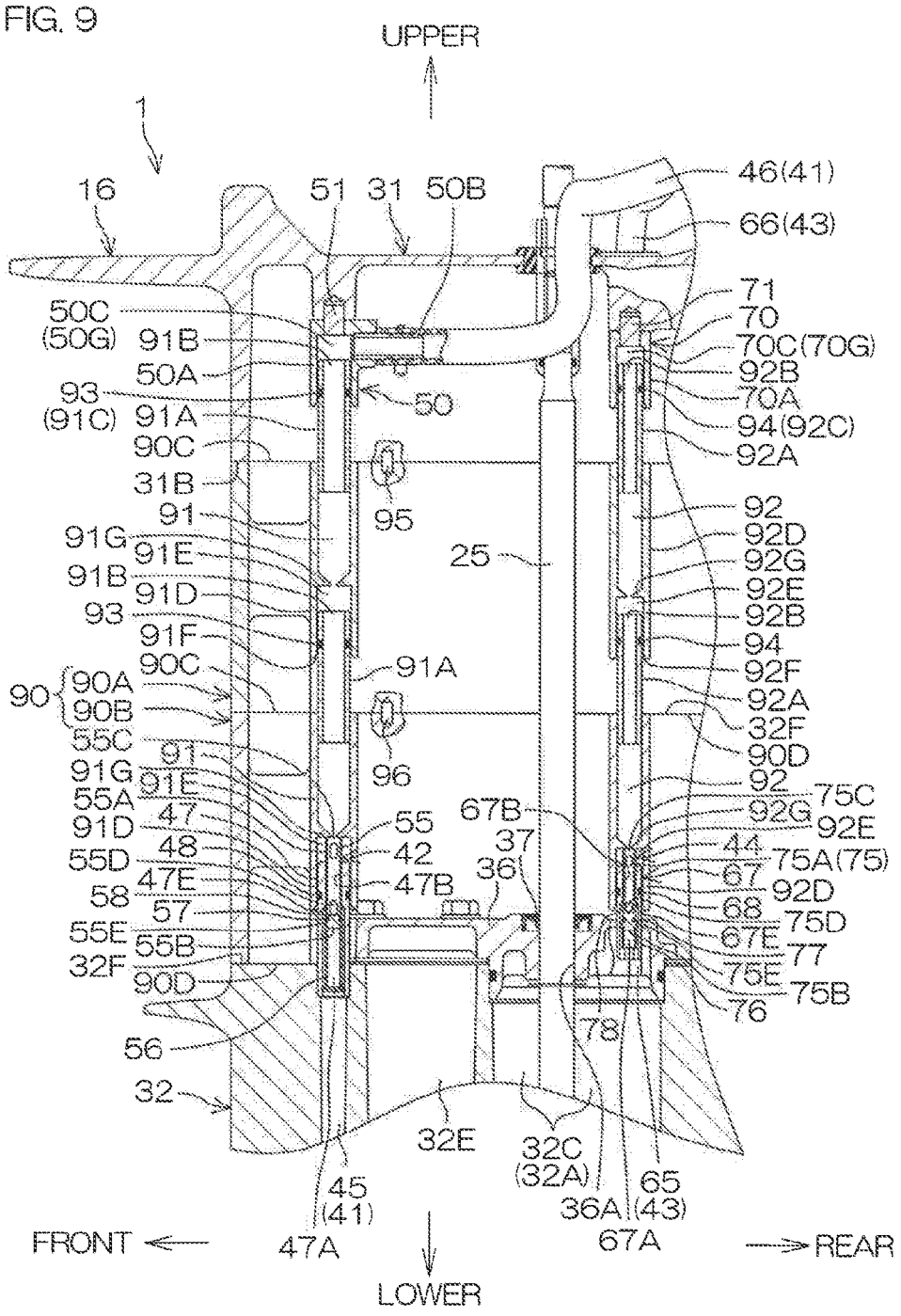
FIG. 9 is a partial cross-sectional view of a main portion of an outboard motor according to another preferred embodiment of the present invention.

FIG. 9 is a partial cross-sectional view of a main portion of an outboard motor 1 according to a second preferred embodiment of the present invention. The same reference numeral is hereinafter given to the same component as each component described in the first preferred embodiment, and a detailed description of this component is omitted. The outboard motor 1 may further include a single or a plurality of extension members 90. The extension member 90 is a hollow body. The extension member 90 is located between the upper case 31 and the lower case 32. This makes it possible to increase the top-bottom size of the outboard motor 1. In FIG. 9, two extension members 90 are located between the upper case 31 and the lower case 32 in a state in which the two extension members 90 are stacked in the up and down direction. In the following description, an upper one of the two extension members 90 is referred to as an extension member 90A, and a lower one of the two extension members 90 is referred to as an extension member 90B when necessary. A relay oil flow passage 91 and a relay air flow passage 92 both of which extend upwardly and downwardly are provided in the extension members 90. The relay oil flow passage 91 defines a portion of the oil flow passage 41. The relay air flow passage 92 defines a portion of the air flow passage 43.

An upper end portion 91A of the relay oil flow passage 91 preferably has the shape of a circular or substantially circular pipe that has a central axis extending in the up-down direction, and protrudes upwardly from an upper surface 90C of the extension member 90. An opening 91B that faces upwardly is provided in an upper end surface of the upper end portion 91A. An annular groove 91C extending in a circumferential direction of an outer peripheral surface of the upper end portion 91A is provided on the outer peripheral surface of the upper end portion 91A. An annular seal 93 is fitted in the groove 91C. A lower end portion of the relay oil flow passage 91 defines a relay oil joint 91D. The relay oil joint 91D preferably has the shape of a circular or substantially circular pipe that has a central axis extending in the up-down direction, and its lower end is at a higher position than a lower surface 90D of the extension member 90.

A relay oil port 91E defining an internal space of the relay oil joint 91D is provided in the relay oil joint 91D. The relay oil port 91E is a cylindrical space extending in the up-down direction, and is a portion of the relay oil flow passage 91, and is opened so as to face downwardly in a lower end surface of the relay oil joint 91D. A chamfer 91F is provided at an inner peripheral edge that rims the relay oil port 91E in the lower end surface of the relay oil joint 91D. An actuator 91G is provided in the relay oil port 91E. An example of the actuator 91G is an annular flange that protrudes from an inner peripheral surface of the relay oil joint 91D. A lower surface of the actuator 91G is a horizontal plane, and an upper surface of the actuator 91G is a tapered surface that becomes higher outwardly in a radial direction.

The relay air flow passage 92 is located at a more rearward position than the relay oil flow passage 91. An upper end portion 92A of the relay air flow passage 92 has a shape of a circular pipe that has a central axis extending in the up-down direction, and protrudes upwardly from the upper surface 90C of the extension member 90. An opening 92B that faces upwardly is provided in an upper end surface of the upper end portion 92A. An annular groove 92 extending in a circumferential direction of an outer peripheral surface of the upper end portion 92A is provided on the outer peripheral surface of the upper end portion 92A. An annular seal 94 is fitted in the groove 92C. A lower end portion of the relay oil flow passage 92 defines an relay air joint 92D. The relay air joint 92D preferably has the shape of a circular or substantially circular pipe that has a central axis extending in the up-down direction, and its lower end is at a higher position than the lower surface 90D of the extension member 90.

A relay air port 92E defining an internal space of the relay air joint 92D is provided in the relay air joint 92D. The relay air port 92E is a cylindrical space extending in the up-down direction, and is a portion of the relay air flow passage 92, and opens downwardly in a lower end surface of the relay air joint 92D. A chamfer 92F is provided at an inner peripheral edge that rims the relay air port 92E in the lower end surface of the relay air joint 92D. An actuator 92G is provided in the relay air port 92E. An example of the actuator 92G is an annular flange that protrudes from an inner peripheral surface of the relay air joint 92D. A lower surface of the actuator 92G extends in a horizontal plane, and an upper surface of the actuator 92G is a tapered surface that becomes higher as it extends outwardly in the radial direction.

In FIG. 9, the extension member 90A is fixed to the upper case 31 by a fastener (not shown), such as a bolt or the like. The extension member 90B is attached to the extension member 90A by another fastener. Therefore, the extension member 90B is fixed to the upper case 31 via the extension member 90A. The lower case 32 is attached to the extension member 90B by the fastener 34 (see FIG. 2).

In this state, the upper surface 90C of the extension member 90A is in contact with the lower surface 31B of the upper case 31, and the upper surface 90C of the extension member 90B is in contact with the lower surface 90D of the extension member 90A. Additionally, the upper surface 32F of the lower case 32 is in contact with the lower surface 90D of the extension member 90B. The upper case 31 and the extension member 90A are positioned in the horizontal direction by a pin-shaped positioning member 95 that straddles therebetween. The extension member 90A and the extension member 90B are positioned in the horizontal direction by a pin-shaped positioning member 96 that straddles therebetween.

In the extension member 90A, the upper end portion 91A of the relay oil flow passage 91 is inserted into the upper oil connection port 50C of the upper oil joint 50 of the upper case 31 from below. Consequently, the upper end portion 91A of the relay oil flow passage 91 is joined to the upper oil joint 50. A gap between the outer peripheral surface of the upper end portion 91A and the inner peripheral surface of the upper oil joint 50, i.e., between the outer peripheral surface of the upper end portion 91A and the inner surface of the upper oil flow passage 46 is closed with the seal 93. The opening 91B of the upper end portion 91A is spaced downwardly from the lower end surface of the actuator 51 in the upper oil connection port 50C, and hence is not closed. Therefore, the relay oil flow passage 91 is connected to the upper oil flow passage 46 via the opening 91B. The relay oil flow passage 91 extends downwardly from the upper oil flow passage 46.

In the extension member 90A, the upper end portion 92A of the relay air flow passage 92 is inserted into the upper air connection port 70C of the upper air joint 70 of the upper case 31 from below. Consequently, the upper end portion 92A of the relay air flow passage 92 is joined to the upper air joint 70. A gap between the outer peripheral surface of the upper end portion 92A and the inner peripheral surface of the upper air joint 70, i.e., between the outer peripheral surface of the upper end portion 92A and the inner surface of the upper air flow passage 66 is closed with the seal 94. The opening 92B of the upper end portion 92A is spaced downwardly from the lower end surface of the actuator 71 in the upper air connection port 70C, and hence is not closed. Therefore, the relay air flow passage 92 is connected to the upper air flow passage 66 via the opening 92B. The relay air flow passage 92 extends downwardly from the upper air flow passage 66.

In the extension member 90B, the upper end portion 91A of the relay oil flow passage 91 is inserted in the relay oil port 91E of the relay oil joint 91D of the extension member 90A from below. Consequently, the upper end portion 91A of the relay oil flow passage 91 is joined to the relay oil joint 91D. A gap between the outer peripheral surface of the upper end portion 91A and the inner peripheral surface of the relay oil joint 91D, i.e., between the outer peripheral surface of the upper end portion 91A and the inner surface of the relay oil flow passage 91 of the extension member 90A is closed with the seal 93. The opening 91B of the upper end portion 91A is spaced downwardly from the lower surface of the actuator 91G in the relay oil joint 91D. The relay oil flow passage 91 of the extension member 90B is connected to the relay oil flow passage 91 of the extension member 90A via the opening 91B. The relay oil flow passage 91 of the extension member 90B extends downwardly from the relay oil flow passage 91 of the extension member 90A.

In the extension member 90B, the upper end portion 92A of the relay air flow passage 92 is inserted in the relay air port 92E of the relay air joint 92D of the extension member 90A from below. Consequently, the upper end portion 92A of the relay air flow passage 92 is joined to the relay air joint 92D. A gap between the outer peripheral surface of the upper end portion 92A and the inner peripheral surface of the relay air joint 92D, i.e., between the outer peripheral surface of the upper end portion 92A and the inner surface of the relay air flow passage 92 of the extension member 90A is closed with the seal 94. The opening 92B of the upper end portion 92A is spaced downwardly from the lower surface of the actuator 92G in the relay air joint 92D. The relay air flow passage 92 of the extension member 90B is connected to the relay air flow passage 92 of the extension member 90A via the opening 92B. The relay air flow passage 92 of the extension member 90B extends downwardly from the relay air flow passage 92 of the extension member 90A.

The lower oil joint 47 of the lower case 32 is joined to the relay oil joint 91D by being inserted into the relay oil port 91E of the relay oil joint 91D of the extension member 90B from below. The lower oil connection port 47B of the lower oil joint 47 is connected to the relay oil port 91E. A gap between the outer peripheral surface of the lower oil joint 47 and the inner peripheral surface of the relay oil joint 91D, i.e., between the outer peripheral surface of the lower oil joint 47 and the inner surface of the relay oil flow passage 91 is closed with the seal 48.

With the lower oil joint 47 being in this state, the valve body 55 of the oil flow passage shutoff valve 42 is brought into contact with the lower surface of the actuator 91G in the relay oil port 91E, and is downwardly pushed by the actuator 91G. Consequently, the flange portion 55E of the valve body 55 is spaced downwardly from the valve seat 47E, and therefore the gap 58 is created between the flange portion 55E and the valve seat 47E. The opening 55C of the upper end of the tube portion 55A of the valve body 55 is not closed with the actuator 91G, and communicates with the relay oil flow passage 91 via a central space of the actuator 91G. Consequently, the lower oil flow passage 45 and the relay oil flow passage 91 communicate with each other via the gap 58, the lower through hole 55D in the tube portion 55A of the valve body 55, the internal space of the tube portion 55A, and the opening 55C of the tube portion 55A. In other words, in a state in which the lower case 32 has been attached to the upper case 31, the oil flow passage shutoff valve 42 is subjected to an opening operation by the actuator 91G, and hence opens the lower oil flow passage 45, and allows the lower oil flow passage 45 and the relay oil flow passage 91 to communicate with each other. The lower oil flow passage 45 communicates with the upper oil flow passage 46 via the relay oil flow passages 91 of the extension members 90A and 90B. Consequently, the oil flow passage 41 is completed, and reaches an open state over its entire area.

The lower air joint 67 of the lower case 32 is joined to the relay air joint 92D by being inserted into the relay air port 92E of the relay air joint 92D of the extension member 90B from below. The lower air connection port 67B of the lower air joint 67 is connected to the relay air port 92E. A gap between the outer peripheral surface of the lower air joint 67 and the inner peripheral surface of the relay air joint 92D, i.e., between the outer peripheral surface of the lower air joint 67 and the inner surface of the relay air flow passage 92 is closed with the seal 68.

With the lower air joint 67 being in this state, the valve body 75 of the air flow passage shutoff valve 44 is brought into contact with the lower surface of the actuator 92G in the relay air port 92E, and is downwardly pushed by the actuator 92G. Consequently, the flange portion 75E of the valve body 75 is spaced downwardly from the valve seat 67E, and therefore the gap 78 is created between the flange portion 75E and the valve seat 67E. The opening 75C of the upper end of the tube portion 75A of the valve body 75 is not closed with the actuator 92G, and communicates with the relay air flow passage 92 via a central space of the actuator 92G. Consequently, the lower air flow passage 65 and the relay air flow passage 92 communicate with each other via the gap 78, the lower through hole 75D in the tube portion 75A of the valve body 75, the internal space of the tube portion 75A, and the opening 75C of the tube portion 75A. In other words, in a state in which the lower case 32 has been attached to the upper case 31, the air flow passage shutoff valve 44 is subjected to an opening operation by the actuator 92G, and hence opens the lower air flow passage 65, and allows the lower air flow passage 65 and the relay air flow passage 92 to communicate with each other. The lower air flow passage 65 communicates with the upper air flow passage 66 via the relay air flow passages 92 of the extension members 90A and 90B. Consequently, the air flow passage 43 is completed, and reaches an open state over its entire area.

The drive shaft 12 (see FIG. 1) and the shift rod 25 extend to the upper case 31 through the internal spaces of the extension members 90A and 90B.

The operator loosens the fastener 34 (see FIG. 2) for maintenance or the like, and detaches the lower case 32 downwardly from the extension member 90B. Thereupon, the lower oil joint 47 comes off downwardly from the inside of the relay oil port 91E of the relay oil joint 91D together with the valve body 55 of the oil flow passage shutoff valve 42. Additionally, the lower air joint 67 comes off downwardly from the inside of the relay air port 92E of the relay air joint 92D together with the valve body 75 of the air flow passage shutoff valve 44. Consequently, the oil flow passage 41 is separated into the lower oil flow passage 45 and the other flow passages (the upper oil flow passage 46 and the relay oil flow passage 91). Additionally, the air flow passage 43 is separated into the lower air flow passage 65 and the other flow passages (the upper air flow passage 66 and the relay air flow passage 92).

When the lower case 32 is thus detached from the extension member 90B, the valve body 55 of the oil flow passage shutoff valve 42 is separated downwardly from the actuator 91G in the relay oil port 91E as shown in FIG. 5. Consequently, the valve body 55 is raised by the urging of the urging member 56, and the flange portion 55E of the valve body 55 approaches the valve seat 47E, and is received by the valve seat 47E in the oil flow passage shutoff valve 42. Thereupon, the seal 57 of the valve body 55 is compressed between the flange portion 55E and the valve seat 47E, and the gap 58 (see FIG. 9) between the flange portion 55E and the valve seat 47E is closed, and hence disappears. Therefore, the lower oil flow passage 45 is shut off at the seal 57. In other words, the oil flow passage shutoff valve 42 closes the lower oil flow passage 45 in a state in which the lower case 32 has been detached from the upper case 31 by having been detached from the extension member 90B.

Additionally, when the lower case 32 is detached from the extension member 90B, the valve body 75 of the air flow passage shutoff valve 44 is separated downwardly from the actuator 92G in the relay air port 92E. Consequently, the valve body 75 is raised by the urging of the urging member 76, and the flange portion 75E of the valve body 75 approaches the valve seat 67E, and is received by the valve seat 67E in the air flow passage shutoff valve 44. Thereupon, the seal 77 of the valve body 75 is compressed between the flange portion 75E and the valve seat 67E, and the gap 78 (see FIG. 9) between the flange portion 75E and the valve seat 67E is closed, and hence disappears. Therefore, the lower air flow passage 65 is shut off at the seal 77. In other words, the air flow passage shutoff valve 44 closes the lower air flow passage 65 in a state in which the lower case 32 has been detached from the upper case 31 by having been detached from the extension member 90B.

The operator who has finished maintenance or the like raises the lower case 32, and allows the lower case 32 to approach the extension member 90B, and attaches it to the upper case 31. At that time, the lower oil joint 47 is inserted into the relay oil port 91E of the relay oil joint 91D from below together with the valve body 55 of the oil flow passage shutoff valve 42. Additionally, the lower air joint 67 is inserted into the relay air port 92E of the relay air joint 92D from below together with the valve body 75 of the air flow passage shutoff valve 44. Consequently, when the lower case 32 is completely attached to the upper case 31, the oil flow passage shutoff valve 42 opens the lower oil flow passage 45, and the air flow passage shutoff valve 44 opens the lower air flow passage 65 as described above (see FIG. 9).

With the second preferred embodiment, it is possible to prevent lubrication oil from leaking out from the detachable lower case 32 in the same way as in the first preferred embodiment. Particularly in the second preferred embodiment, the lower oil joint 47 of the lower oil flow passage 45 and the relay oil joint 91D of the relay oil flow passage 91 in the extension member 90 are joined together when the lower case 32 is attached to the extension member 90. Consequently, the actuator 91G of the relay oil joint 91D applies an opening operation to the oil flow passage shutoff valve 42 built into the lower oil joint 47, and therefore the oil flow passage shutoff valve 42 opens the lower oil flow passage 45. Thereupon, the upper oil flow passage 46, the relay oil flow passage 91, and the lower oil flow passage 45 are connected together, and the oil flow passage 41 reaches an open state. On the other hand, when the lower case 32 is detached from the extension member 90, the connection between the lower oil joint 47 and the relay oil joint 91D is released. Consequently, the actuator 91G does not apply an opening operation to the oil flow passage shutoff valve 42, and therefore the oil flow passage shutoff valve 42 closes the lower oil flow passage 45. It is possible to realize the opening and closing of the lower oil flow passage 45 by the oil flow passage shutoff valve 42 in conjunction with the connection or disconnection between the lower oil joint 47 and the relay oil joint 91D in response to the attaching or detaching of the lower case 32 to or from the upper case 31 as thus described.

In the second preferred embodiment, the valve body 55 of the oil flow passage shutoff valve 42 is downwardly pushed by the actuator 91G in the relay oil port 91E of the relay oil flow passage 91 when the lower case 32 is attached to the extension member 90. Consequently, the gap 58 that allows the relay oil flow passage 91 and the lower oil flow passage 45 to communicate with each other is created between the valve body 55 and the valve seat 47E in the oil flow passage shutoff valve 42. Therefore, it is possible to realize the opening action of the lower oil flow passage 45 by the oil flow passage shutoff valve 42. On the other hand, when the lower case 32 is detached from the extension member 90, the valve body 55 is not pushed by the actuator 91G, and the valve body 55 that is raised by the urging of the urging member 56 approaches the valve seat 47E in the oil flow passage shutoff valve 42. Consequently, the gap 58 that allows the relay oil flow passage 91 and the lower oil flow passage 45 to communicate with each other closes, and therefore it is possible to realize the closing action of the lower oil flow passage 45 by the oil flow passage shutoff valve 42.

In the second preferred embodiment, the lower oil joint 47 is inserted into the relay oil port 91E in a state in which the oil flow passage shutoff valve 42 has opened the lower oil flow passage 45. In this situation, the lower oil connection port 47B of the lower oil joint 47 is connected to the relay oil port 91E in the relay oil flow passage 91. This makes it possible to prevent lubrication oil in the oil flow passage 41 from leaking out from a joint between the lower oil connection port 47B and the relay oil port 91E because the joint reaches an unexposed state to the outside of the oil flow passage 41 that has been opened.

In the second preferred embodiment, the seal 48 prevents lubrication oil in the oil flow passage 41 from leaking out from the gap between the lower oil joint 47 and the inner surface of the relay oil flow passage 91.

Also, features of two or more of the various preferred embodiments described above may be combined.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An outboard motor comprising:

an engine;

a drive shaft that extends downwardly from the engine and that is rotated by the engine;

a gearing connected to a lower end of the drive shaft;

a propeller shaft to which a propeller is attached and to which rotation of the drive shaft is transmitted via the gearing;

an upper case located below the engine and that houses the drive shaft;

a lower case including an oil reservoir chamber housing the gearing and lubrication oil, the lower case being located below the upper case and being attachable to and detachable from the upper case;

an oil flow passage including an upper oil flow passage provided in the upper case and a lower oil flow passage provided in the lower case and that is connected to the oil reservoir chamber, the oil flow passage guiding lubrication oil when lubrication oil in the oil reservoir chamber is replaced, the oil flow passage being separated into the upper oil flow passage and the lower oil flow passage when the lower case is detached from the upper case; and an oil flow passage shutoff valve that opens the lower oil flow passage in a state in which the lower case has been attached to the upper case, and that closes the lower oil flow passage in a state in which the lower case has been detached from the upper case.

2. The outboard motor according to claim 1, further comprising:

a lower oil joint provided at the lower oil flow passage and into which the oil flow passage shutoff valve is located; and an upper oil joint provided at the upper oil flow passage and that is connectable to the lower oil joint and that includes an actuator by which the oil flow passage shutoff valve is subjected to an opening operation.

3. The outboard motor according to claim 2, wherein the upper oil joint includes an upper oil connection port that opens downwardly;

the actuator is provided in the upper oil connection port;

the lower oil joint includes a lower oil connection port that opens upwardly and that is connected to the upper oil connection port;

the oil flow passage shutoff valve includes a valve body that is slidable upwardly and downwardly in the lower oil flow passage, a valve seat that receives the valve body, and an urging force generator that upwardly urges the valve body toward the valve seat, a gap that allows the upper oil flow passage and the lower oil flow passage to communicate with each other and is located between the valve body and the valve seat by allowing the valve body to be downwardly pushed by the actuator in a state in which the oil flow passage shutoff valve has opened the lower oil flow passage; and when the lower case is detached from the upper case, the valve body approaches the valve seat by urging of the urging force generator to close the gap, and, as a result, the oil flow passage shutoff valve closes the lower oil flow passage.

4. The outboard motor according to claim 3, wherein the lower oil joint is inserted into the upper oil connection port in a state in which the oil flow passage shutoff valve has opened the lower oil flow passage.

5. The outboard motor according to claim 4, further comprising a first seal that closes a gap between the lower oil joint inserted into the upper oil connection port and an inner surface of the upper oil flow passage.

6. The outboard motor according to claim 1, further comprising:

an extension located between the upper case and the lower case and that is fixed to the upper case;

a lower oil joint provided at the lower oil flow passage and into which the oil flow passage shutoff valve is located;

a relay oil flow passage provided at the extension and that extends downwardly from the upper oil flow passage; and a relay oil joint provided at the relay oil flow passage, the relay oil joint being connectable to the lower oil joint, the relay oil joint including an actuator that applies an opening operation to the oil flow passage shutoff valve.

7. The outboard motor according to claim 6, wherein the relay oil flow passage includes a relay oil port that opens downwardly;

the actuator is provided in the relay oil port;

the lower oil joint includes a lower oil connection port that opens upwardly and that is connected to the relay oil port;

the oil flow passage shutoff valve includes a valve body that is slidable upwardly and downwardly in the lower oil flow passage, a valve seat that receives the valve body, and an urging force generator that upwardly urges the valve body toward the valve seat;

a gap that allows the relay oil flow passage and the lower oil flow passage to communicate with each other is located between the valve body and the valve seat by allowing the valve body to be downwardly pushed by the actuator in a state in which the oil flow passage shutoff valve has opened the lower oil flow passage; and when the lower case is detached from the extension, the valve body approaches the valve seat by urging of the urging force generator to close the gap, and, as a result, the oil flow passage shutoff valve closes the lower oil flow passage.

8. The outboard motor according to claim 7, wherein the lower oil joint is inserted into the relay oil port in a state in which the oil flow passage shutoff valve has opened the lower oil flow passage.

9. The outboard motor according to claim 8, further comprising a second seal that closes a gap between the lower oil joint inserted into the relay oil port and an inner surface of the relay oil flow passage.

10. The outboard motor according to claim 3, wherein the oil flow passage shutoff valve further includes a third seal attached to the valve body and that closes a gap between the valve body and the valve seat by being compressed between the valve body and the valve seat in a state in which the lower case has been detached from the upper case.

11. The outboard motor according to claim 1, further comprising:

an air flow passage including an upper air flow passage provided in the upper case and that is opened to atmosphere when lubrication oil in the oil reservoir chamber is replaced, and a lower air flow passage provided in the lower case and that is connected to the oil reservoir chamber; wherein the air flow passage is separated into the upper air flow passage and the lower air flow passage when the lower case is detached from the upper case.

12. The outboard motor according to claim 11, further comprising:

an air flow passage shutoff valve that opens the lower air flow passage in a state in which the lower case has been attached to the upper case, and that closes the lower air flow passage in a state in which the lower case has been detached from the upper case.

13. The outboard motor according to claim 1, wherein the lower case is attachable to and detachable from the upper case together with the drive shaft.

14. The outboard motor according to claim 1, wherein the outboard motor is turnable around a tilting shaft extending in a horizontal direction between a tilt-down position in which the lower case is positioned in water and a tilt-up position in which the lower case is positioned above a water surface;

a forward end in the upper oil flow passage that is farthest from the oil reservoir chamber is located at a higher position than the tilting shaft; and the outboard motor further comprises a coupler provided at the forward end and that makes a one-touch connection with external equipment for lubrication oil replacement.

* * * * *